US009574361B2

(12) United States Patent
Dose

(10) Patent No.: US 9,574,361 B2
(45) Date of Patent: Feb. 21, 2017

(54) SYSTEM AND METHOD FOR A DISAPPEARING SPA COVER LIFTER

(71) Applicant: Curtis Richard Dose, San Diego, CA (US)

(72) Inventor: Curtis Richard Dose, San Diego, CA (US)

( * ) Notice: Subject to any disclaimer, the term of this patent is extended or adjusted under 35 U.S.C. 154(b) by 0 days.

(21) Appl. No.: 14/811,142

(22) Filed: Jul. 28, 2015

(65) Prior Publication Data

US 2016/0053505 A1 Feb. 25, 2016

Related U.S. Application Data

(60) Provisional application No. 62/041,612, filed on Aug. 25, 2014, provisional application No. 62/153,067, filed on Apr. 27, 2015.

(51) Int. Cl.
*E04H 4/08* (2006.01)

(52) U.S. Cl.
CPC ..... *E04H 4/084* (2013.01)

(58) Field of Classification Search
CPC ..... E04H 4/08; E04H 4/084; E04H 4/108
See application file for complete search history.

(56) References Cited

U.S. PATENT DOCUMENTS 4,991,238 A 2/1991 Forrest
5,048,153 A 9/1991 Wall et al.
5,819,332 A 10/1998 Perry
5,974,600 A 11/1999 Pucci et al.
5,996,137 A 12/1999 Genova
6,000,071 A * 12/1999 Fettes ..... E04H 4/084 4/498
6,442,799 B1 * 9/2002 Duarte ..... E04H 4/084 16/277
6,795,984 B1 * 9/2004 Brady ..... E04H 4/084 220/263
8,726,429 B1 5/2014 Midkiff
8,813,275 B2 8/2014 Genova
2007/0209103 A1 * 9/2007 Buzzetti ..... E04H 4/084 4/498

(Continued)

OTHER PUBLICATIONS

HotSpring—Cover Lifters, Retrieved from http://www.hotspring.com/hot-tub-accessories/hot-tubs-cover-lifters-hot-spring-spa-cover-lifters, Retrieved on Aug. 3, 2015 (3 pages total).

(Continued)

*Primary Examiner* — Tuan N Nguyen
(74) *Attorney, Agent, or Firm* — Mark D. Wieczorek; Mayer & Williams PC

(57) ABSTRACT

A spa cover lifting device that easily lifts and stows the removed cover out of sight below the upper edge of the spa is disclosed. When closing, the lifter assists the cover up out of its hidden stowage, and guides the cover back into position on the spa. One difference in this design from current art is that the spa cover when stowed disappears out of sight to those in the spa, below the top edge of the spa. Current spa cover lifters generally all park at least part of the stowed cover above the top edge of the spa, blocking views and reducing apparent roominess. Fourteen exemplary methods are shown to accomplish such a spa cover lifter, accommodating different size spas and cover designs, but it could also be done in other ways.

6 Claims, 23 Drawing Sheets

(56) References Cited

U.S. PATENT DOCUMENTS

| | | | | |
|---|---|---|---|---|
| 2011/0048654 | A1* | 3/2011 | Kolar | E04H 4/084<br>160/188 |
| 2013/0104307 | A1 | 5/2013 | Genova | |

OTHER PUBLICATIONS

Caldera Spas—Covers & Lifters, Retrieved from http://www.calderaspas.com/accessories/covers-and-lifters, Retrieved on Aug. 3, 2015 (4 pages total).
Fantasy Spa, Retreived from http://fantasy-spas.com/shop-spas/, Retrieved on Aug. 6, 2015 (3 pages total).
Freeflow Spas, Retrieved from http://freeflowspas.com/shop-spas/excursion/, Retrieved on Aug. 6, 2015 (3 pages total).
Leisure Concepts—Cover Lifts, Retrieved from http://leisureconcepts.com/products/cover-lifts/, Retrieved on Jul. 24, 2015 (1 page total).
Leisure Concepts—Cover Mate I, Retrieved from http://leisureconcepts.com/products/cover-lifts/covermate-i/, Retrieved on Jul. 27, 2015 (1 page total).
Leisure Concepts—Cover Mate II, Retrieved from http://leisureconcepts.com/products/cover-lifts/covermate-ii/, Retrieved on Jul. 27, 2015 (1 page total).
Leisure Concepts—Smartop Cover, Retrieved from http://leisureconcepts.com/products/smartop-cover/, Retrieved on Jul. 27, 2015 (2 pages total).
Leisure Concepts Dealer Catalog, Retrieved at http://leisureconcepts.com/assets/PDF/Leisure-Concepts-Catalog-2015.pdf, Retrieved on Jul. 27, 2015 (36 pages total).

* cited by examiner

SYSTEM AND METHOD FOR A DISAPPEARING SPA COVER LIFTER

CROSS-REFERENCE TO RELATED APPLICATIONS

This application claims benefit of priority of U.S. Provisional Patent Applications:

1. 62/041,612, filed Aug. 25, 2014, entitled "DISAPPEARING SPA COVER LIFTER", and
2. 62/153,067, filed Apr. 27, 2015, entitled "DISAPPEARING SPA COVER LIFTER", both of which are incorporated by reference herein in their entireties.

FIELD

Aspects of this document relate generally to spas, spa covers, and spa cover lifters.

BACKGROUND

There are numerous patented and produced spa cover lifter designs on the market. But all the existing designs stow the folded spa cover stack so it protrudes above the top of the spa, blocking the view of occupants in or near the spa. Reading spa owner's comments in on-line spa forums, and conversations with spa store personnel, reveal that many spa owners and prospective owners do not want the cover protruding above the top edge of the spa when folded and stowed. They want the cover to disappear. Brochures from spa manufacturers show all their spas uncovered with no cover in sight, despite the fact that virtually all spas are sold with and use covers—for safety, cleanliness and thermal efficiency. They picture them without the covers because with their lifters, the covers, when open, stick up and intrude on the serene atmosphere of the open spa, and block views.

Owners reclining in their spa usually have their head and eye level close to the top edge of the spa. So a stowed cover that sticks up even a few inches blocks the vision completely in that direction. A cover that sticks up even one foot above the spa top seems like a wall, drastically decreasing the open feeling of the spa environment. Spa owners need and want the cover—they must have one—but they want it to disappear when open, without hauling the 40-60 lb. cover into another room. When they are ready to use the spa, they want the cover to quietly, quickly and easily disappear. A wife should be able to uncover the spa by herself, without struggling with the heavy weight of the cover, and make the cover disappear. She should be able to quickly and effortlessly lift the heavy cover back up from its hidden stowage, back onto the spa, in precisely the correct aligned position. This can be even more crucial for elderly or disabled owners with limited strength.

Some prior efforts disclose lifting mechanism for spa cover lifters that purport to stow the folded cover stack below the top edge of the spa. One stows a divided and folded cover on both sides of the spa—U.S. Pat. No. 5,974,600, entitled "Spa cover" discloses a split bi-folding cover and cover lifters for a spa. The cover consists of two equal members mounted on both sides of the spa, each having two panels outwardly foldable. The inner panel of each panel member can be folded or pivoted outwardly in opposite directions onto the outer panels to expose the central portion of the spa. The folded panel members can then be folded outward to expose the entire spa, then each lowered to be out of sight. The bi-folding configuration stores below the top edge of the spa, but requires the panels to be stored on two sides of the spa, so there are two independent and duplicate opening and closing procedures, one on each side, and entry to the spa is restricted by folded cover stacks on two sides of the spa. The lowering mechanism is highly complicated and requires the user to exit the spa to lower the folded cover stacks, then again to raise them when it is time to close the cover.

Two other prior efforts illustrate impossible vertical adjacent stowages of a single-fold cover above the pad and below the top edge of the spa. Virtually all current spas sold are more than twice as wide as they are tall, meaning that a single-fold spa cover that is wide enough to cover the entire spa width, when folded, would be wider than the spa is tall. So if this folded cover is stored on the pad vertically adjacent to the spa, the cover stack must protrude above the upper edge of the spa.

One such is U.S. Pat. No. 4,991,238, entitled "Spa cover lift" which discloses an apparatus attachable to the side of the spa for receiving and retaining the spa cover. The device includes a movable frame that is pivotably attachable to the spa such that the movable frame can be displaced between extended and retracted positions with respect to the side of the spa. The cover must be slid from the top surface of the spa onto the supportive surface. This is not actually a spa cover lifter in that the user must man-handle the folded spa cover off the spa and into the carrier. The user then must exit the spa to fold the carrier down beside the spa, and out of his view. Then, before covering the spa, the user would have to again exit the spa to access the handles to unfold the carrier back to level, then get back into the spa to man-handle the folded cover stack off the carrier and back onto the spa, then exit the spa to finish unfolding the cover. The spa illustrated is freakishly narrow and tall. Although the illustrations show the folded cover stowed vertically adjacent to the spa, and below the top edge of the spa, this would not be dimensionally possible with normal spa sizes and a single-fold cover (see Table II).

Another, U.S. Pat. No. 5,048,153, entitled "Spa cover lift mechanism" discloses a spa cover lift frame comprising a single-fold cover mounted on the spa using a frame which includes left and right mounting brackets configured to be mounted to the respective left and right spa side walls adjacent the storage-side wall. Each of the left and right mounting brackets consist of an elongated bracket flange configured to be mounted flush against a side wall of the spa with the second end adjacent the spa storage-side wall. Pivots are situated on the mounting brackets, as are pivot stops. A "U" shaped reinforced carrier, including opposed substantially parallel support arm members and a cross member extending between the support arm members, is mounted to the brackets for pivotal motion about a lift axis. The left and right mounting brackets and the carrier are configured to be mounted on the spa side walls with the carrier pivotably on the lift axis between a down position where the cross member is positioned against the spa cover adjacent the hinge such that the spa cover may be folded over the cross member, and a raised position where the folded spa cover is supported on the cross member and is substantially upright and adjacent to the spa end wall. Although the illustrations, with a freakishly narrow and tall spa, show the folded cover stowed vertically adjacent to the spa above the pad and below the top edge of the spa, this would not be dimensionally possible with normal spa sizes and a single-fold cover (see Table II). The folded cover stack is only supported near the hinge line and freely pivots near the hinge line, until freely suspended in the stowed position. Unless another person is available to support the storage side of the cover stack during opening and closing, the cover stack would rub heavily on the storage-side upper lip of the spa when opening and closing, causing drag, and likely damaging the gelcoat finish of the spa and the underside of the spa cover. Such underside spa cover damage can allow water invasion and resultant increased weight, accelerating the damage.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

Systems and methods according to present principles meet the needs of the above in several ways. In particular, the spa cover lift mechanism according to present principles, in one implementation, installs a compact mechanical unit on two opposing sides of the spa, attached by a cross bar across the top of the spa folding cover at the hinge line. Using only or primarily springs or air-struts and mechanical advantage, the mechanism allows spa owners to fold their spa cover over either a cross bar or direct spa cover attachments, then with one finger lift the cover stack and effortlessly or with reduced effort nudge the cover stack over the stowage-side of the spa, where the cover lowers itself to store immediately beside the spa, with the entire cover stack and mechanism disappearing below the top edge of the spa.

After the spa session, the spa owner can, with one finger, lift the cover stack out of its stowed position, up and over the edge of the spa, and have it guide perfectly and securely into the proper closed position. The owner then unfolds the folded cover portion(s) to cover the entire spa and latch only that final portion. The stowage-side portion of the spa cover is held firmly closed by the opening mechanism and needs no latches, an attractive convenience, especially if the back half of the spa is in snow or on another deck level.

In one aspect, the invention is directed towards a spa cover lifting device, configured to be coupled to and between a spa and a spa cover, where the spa cover has a stowed configuration not covering the spa and a deployed configuration in which the spa is covered, and where the spa cover lifting device is configured to move the spa cover between the stowed configuration and the deployed configuration, and vice-versa, and such that in the stowed configuration the spa cover is disposed on at least one side of the spa and below a top plane of the spa.

Implementations of the invention may include one or more of the following. The spa cover lifting device may further include at least two lever arms, one on each side of the spa, and may further include at least one spring, configured to pull on one or more of the lever arms, attached to a supporting cross bar extending between two sides of the spa cover, to assist in lifting the cover up, over and down into its stowed position when transitioning from the deployed configuration to the stowed configuration, and the lifting device may be configured such that, when moving from the stowed configuration to the deployed configuration, the movement is assisted by the spring to lift and guide the spa cover into the deployed configuration. The spa cover may have a single-fold, such that the spa cover has a folded configuration and a non-folded configuration, and where the lifting device is configured to stow the spa cover in a folded configuration vertically adjacent to the spa, and whereby the spa has a vertical stack space on a stowage-side of the spa below the top plane of the spa down to below the level of a pad on which the spa sits that is taller than the spa cover in the folded configuration, and where all portions of the spa cover are below the top plane of the spa in the stowed configuration. The spa cover may alternatively have a single-fold, such that the spa cover has a folded configuration and a non-folded configuration, and where the lifting device is configured to stow the spa cover in a folded configuration and in the stowed configuration at an inclined angle adjacent the spa, such that all portions of the spa cover are below the top plane of the spa. Where the spa cover has a single-fold, the spa cover may have a folded configuration and a non-folded configuration, and the lifting device may be configured to stow the spa cover in a folded configuration where the spa is built-in and surrounded by a raised decking, and in the stowed configuration the lifting device may be configured to store the spa cover in the folded configuration on or above a raised decking of the built-in spa, such that all portions of the spa cover are below the top plane of the spa. The spa cover may be split in the middle into two halves, and each half of the spa cover may be folded such that, when stowing each spa cover half, an inside section folds over an outside section, and moreover two lifting devices may be provided, where each lifting device independently lifts the folded half cover over the side to a vertical adjacent stowed position below the top plane of the spa when in the stowed configuration, and where the lifting devices are configured to guide and help lift the folded cover halves back up from the stowed position back to the deployed configuration on top of the spa.

The spa cover may also have a double-fold, in a "Z" pattern, such that the spa cover has a folded configuration and a non-folded configuration, and the lifting device may be configured to stow the spa cover in a folded configuration vertically adjacent to the spa, where all portions of the spa cover are below the top plane of the spa. The spa cover lifting device may further include a plurality of torsion bars, each torsion bar in a respective hinge line of the double-fold cover, and the torsion bars may be configured to assist in the level folding and unfolding operations of the spa cover, such that a first folding cover section tends to stay horizontal as it is lifted and pivoted on a second cover section, until the first and second cover sections are resting on a third cover section, and in the same way the first section tends to stay horizontal during the unfolding operation. The lifting device may be configured to attach directly to imbedded nut plates in a lowest section of the spa cover. The spa cover may have a double-fold, in a rolling pattern, such that the spa cover has a folded configuration and a non-folded configuration, and the lifting device may be configured to stow the spa cover in a folded configuration vertically adjacent to the spa, where all portions of the spa cover are below the top plane of the spa. The lifting device may further be configured to attach directly to imbedded nut plates in a lowest section of the spa cover. The lifting device may further be configured to attach directly to one or more bolt plates attached to a lowest section of the spa cover. The spa cover lifting device may further include at least two lever arms, one on each side of the spa, attached to a supporting cross bar, and may further include at least one air-strut attached to a pivoting bracket, configured to push on one or more of the lever arms to assist in lifting the cover up, over and down into its stowed position when transitioning from the deployed configuration to the stowed configuration, and the lifting device may be configured such that, when moving from the stowed configuration to the deployed configuration, the movement is assisted by the air-strut to lift and guide the spa cover into the deployed configuration.

The lever arms may be bent stowage side lever arms, with weight-compensating air-struts, and the lifting device may be configured to stow a single-fold spa cover in a folded configuration vertically or in an inclined position adjacent to the spa using the bent stowage-side lever arms attached to a stowage side of a lowest cover section to control and support a stowage side of the spa cover in the folded configuration, where all portions of the spa cover are below the top plane of the spa. The lever arms may further be bent stowage side lever arms, with weight-compensating air-struts, where the lifting device is configured to stow a double-fold spa cover in a folded configuration vertically adjacent to the spa using the bent stowage-side lever arms attached to a stowage side of a lowest cover section to control and support a stowage side of the spa cover in the folded configuration, where all portions of the spa cover are below the top plane of the spa.

The lifting device may be configured to stow the spa cover in a folded configuration vertically or in an inclined position adjacent to the spa, where the lifting device includes the lever arm on each side which is coupled to a cross-bar adjacent to a fold of the spa cover, and where each lever arm is attached to a swivel mechanism on each side of the spa, where the lever arm is coupled to a weight compensation spring or air-strut, and may further include a bumper stop configured to arrest movement of the lifting device when the lever arm is in a fully extended open position.

The spa cover may have a double-fold, where the lifting device is configured to stow the spa cover in a folded configuration vertically adjacent to the spa, where all portions of the spa cover are below the top plane of the spa, where the lever arm is a bent lever arm on each fold-side which allows an air-strut to travel past the pivot point such that the air-strut is re-compressing as the cover reaches full closure, to cushion the closing and also provide a lift assist on initial opening, and where each lever arm is attached to one or more imbedded nut plates or bolt plates in the lowest section of the cover stack. The spa cover lifting device may further include adapter plates and a crossbar, such that the lifting device may be used with spa covers not outfitted with imbedded nut plates. The cross bar may be telescoping to allow flexible sizing, and may be made of wood.

The spa cover lifting device may further include nylon straps extending under the spa cover between one or more stowage-side side plates to support the spa cover. The spa cover lifting device may further include an electric motor on each side, the electric motor including a spur gear, sprocket, limit switches and an open-close key switch, the electric motor configured to engage the spa cover lifting device to controllably move the spa cover from the deployed configuration to the stowed configuration, or vice versa, upon a turn of a key or press of a button. The spa cover lifting device may be constructed from aluminum, steel, stainless steel, injection-molded plastic, or brass, or has additional powder coating or other treatments to improve appearance, ease manufacturing and/or to reduce corrosion or rusting.

The spa cover may have a single-fold or a double-fold, such that the spa cover has a folded configuration and a non-folded configuration, and where the cross bar is fitted into a full-width tubular passage along a hinge line of a fold of the cover. One or more or each of the lever arms may be telescoping to allow flexible sizing.

In another aspect, the invention is directed towards a spa cover for a spa that is double-folded in sections in a "Z" pattern to form a stack, wherein a width of the spa cover stack is only one third a width of the spa, wherein a fastener holds the cover stack together when opening or closing, whereby the cover stack is securely compacted to allow the cover stack to be stowed vertically adjacent to the spa, where all portions of the spa cover are below a top plane of the spa.

Implementations of the invention may include one or more of the following. The fastener may include magnets imbedded in the cover sections that align when the cover is folded to keep the cover stack closed during opening and closing.

In another aspect, the invention is directed towards a spa cover for a spa that is double-folded in sections in a rolling pattern to form a stack when folded, where the width of the spa cover stack is one third a width of the spa plus an additional portion corresponding to the thickness of the spa cover, to allow the rolling fold, whereby the narrower cover stack allows the cover stack to be stowed vertically adjacent to the spa, where all portions of the spa cover are below a top plane of the spa.

Advantages of the invention may include, in certain embodiments, one or more of the following. Systems and methods according to present principles provide a handy way for spa users to handle their spa covers, removing the same and deploying the same, where when stowed the spa cover does not obstruct a spa user's view or otherwise create a deleterious view for the user. Other advantages will be understood from the description that follows, including the figures and claims.

This Summary is provided to introduce a selection of concepts in a simplified form. The concepts are further described in the Detailed Description section. Elements or steps other than those described in this Summary are possible, and no element or step is necessarily required. This Summary is not intended to identify key features or essential features of the claimed subject matter, nor is it intended for use as an aid in determining the scope of the claimed subject matter. The claimed subject matter is not limited to implementations that solve any or all disadvantages noted in any part of this disclosure.

BRIEF DESCRIPTION OF THE DRAWINGS

FIG. 8(A) shows a "Z" double-fold cover. FIG. 8(B) shows a roll type double-fold cover.

FIG. 18(A) shows an additional tension spring and FIG. 18(B) shows an additional torsion spring, according to present principles.

Like reference numerals refer to like elements throughout. Elements are not to scale unless otherwise noted.

DETAILED DESCRIPTION

Figure 1:
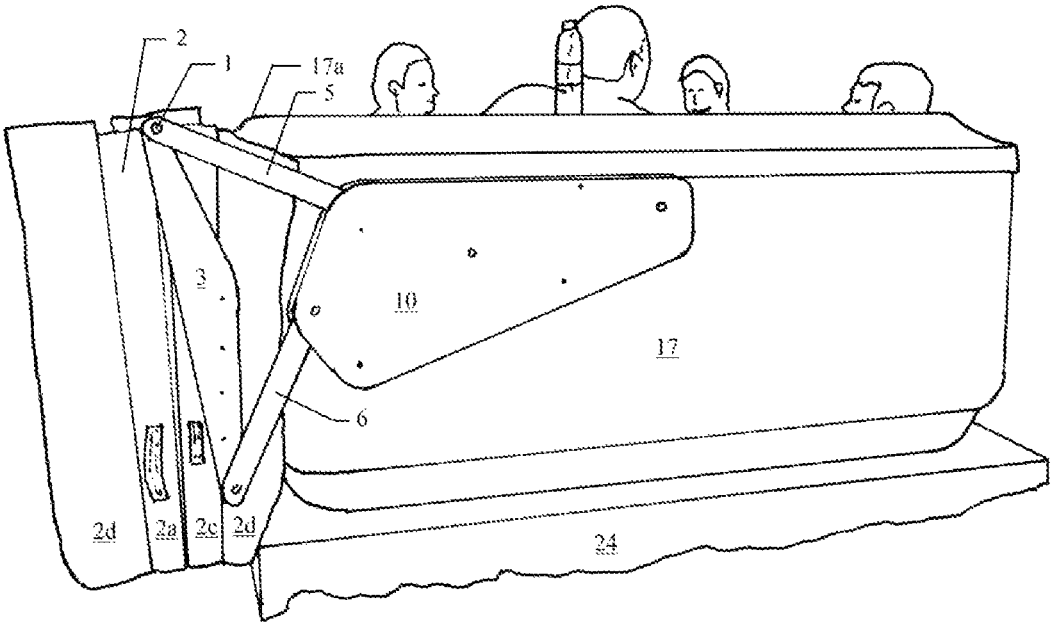
FIG. 1 is a perspective view of an implementation of a spa cover lifter with vertical adjacent stowage partially below pad level according to present principles.
Figure 2A:
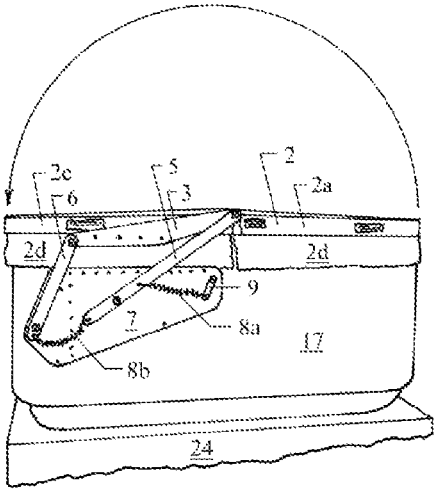
FIGS. 2(A)-2(D) are four side views of an implementation of a spa cover lifter with vertical adjacent stowage partially below pad level according to present principles.
Figure 2B:
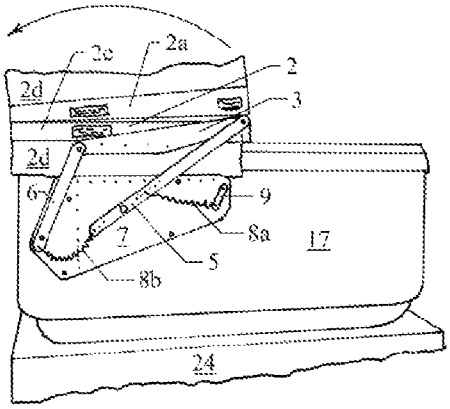
Figure 2C:
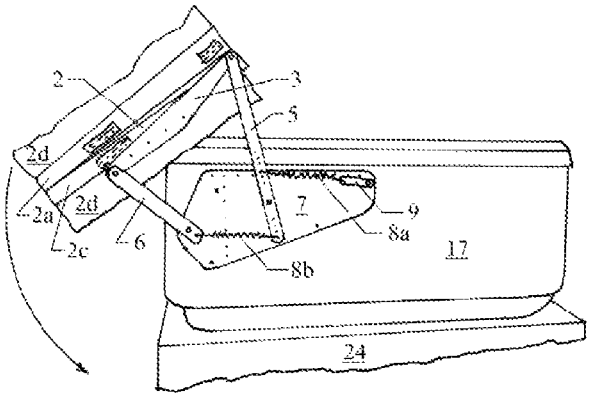
Figure 2D:
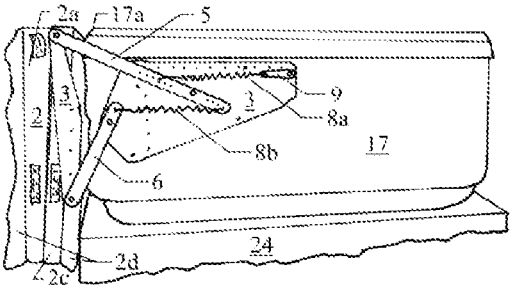

FIG. 1 provides a perspective view of a spa with a cover lifting mechanism that stows a single-fold cover vertically adjacent to the spa, in the open position—shown with the outer mounting plates 10 attached. FIGS. 2(A)-2(D) are four side views of a spa with a cover lifting mechanism that stows a single-fold cover vertically adjacent to the spa, but this time in the cover closed, cover folded, opening, and open positions—shown with the outer mounting plates removed.

In these figures, a spa 17 is illustrated on a spa pad 24. A spa cover 2 is shown which is constituted of sections 2*a* and 2*c*, each having a spa cover skirt 2*d*. In particular, section 2*a* is termed a first-fold cover section and section 2*c* is termed a final fold cover section. In this implementation, two sections are formed when the spa cover 2 has one fold, i.e., has a single-fold or monofold or unifold configuration. In other implementations, a spa cover 2 may have two folds and three sections, i.e., has a bifold or double-fold configuration. In this latter implementation, a middle section 2*b* is used which is termed a middle-fold cover section (see, e.g., FIG. 9).

The lifting mechanism may be covered for safety and appearance, and in more detail may be enclosed by an inner mounting plate 7 and an outer mounting plate 10. Two arms may emanate from the lifting mechanism, shown in the figure by fold-side lever arm 5 and stowage-side lever arm 6. It will be understood that a similar lifting mechanism, which may be mirror images of each other, may be disposed on the other side of the spa, not shown. A cross bar 1 may connect one lifting mechanism to the other, and a side plate 3 may connect the arms 5 and 6 together, and to the lower spa cover section 2*c*. Also shown in FIG. 1 is a spa upper lip 17*a*, and in particular a stowage-side upper lip 17*a*.

Referring next to FIGS. 2(A)-2(D), in which a lifting mechanism 100 is shown with the outer mounting plate removed, a spring 8*a* may be situated between the mid-section of the fold-side lever arm 5 and a swivel 9 attached to the inner mounting plate 7, and a spring 8*b* may be situated between the distal ends of the lever arms 5 and 6. Such springs allow convenient removal and deployment of the spa cover in a controlled and leveraged way.

FIGS. 2(A)-2(D) illustrate steps of using the lifting mechanism 100 to remove the spa cover 2 from the spa 17. In more detail, in FIGS. 1 and 2, the "disappearing" cover lift mechanism design stores the folded cover 2 vertically adjacent to the spa on any spa that has a vertical stack space on the stowage-side of the spa and below the top edge of the spa that is taller than the folded cover stack. On the most common single-fold, fold-in-half spa covers, this means the spa height must be taller than half the spa width along the axis perpendicular to the stowage side (highly unusual), or there must be no obstruction for the folded cover stack to extend below the pad 24 at the bottom of the spa 17. This can be generally done with a spa 17 mounted at the edge of a pad 24 or deck, allowing additional inches of drop. Existing concrete pads 24 can be cut off flush to the stowage-side of the spa 17. Or the spa 17 can be raised slightly on bricks, cinder blocks, etc. New spa 17 installations can simply specify pouring the concrete pad 24 so the stowage-side of the pad 24 is flush with the edge of the spa 17.

A specific example is provided below, and similar specific implementations are described with respect to certain others of the figures.

One design sized for a Jacuzzi brand J-365 spa using vertical adjacent stowage includes a cross bar 1 that is trapped between a single-fold spa cover 2, side plates 3 that grab the spa cover 2, cover lift pads 4, fold-side lever arms 5, stowage-side lever arms 6, inner mounting plates 7, springs 8*a* and 8*b*, swivels 9, and outer mounting plates 10.

1. One Cross Bar 1—The ¾"×94" steel tube has ⅜" couplers 11 glued into each end. The cross bar rests on top of the spa cover 2 in the closed position. As the first-fold cover half 2*a* is folded back over the other half 2*c* of the cover 2 in preparation for removal, the cross bar 1 is trapped between the two cover halves 2*a* and 2*c*.

2. These two stacked cover halves 2*a* and 2*c* hang from the cross bar 1 when the cover 2 is in the open position, and are further supported by the side plates 3 attached to the storage-side lever arms 6.
3. Two Side Plates 3—5/16"×3.5"×32" powder-coated aluminum plates are fixed to each side of the stowage-side half 2*c* of the spa cover 2 with five #20×1.75" stainless bolts 12 each through the side plate 3, then the cover skirt 2*d*, then 1"×1"×18" rubber strips 13 and #20 nylon lock nuts 14 on the inside. The rubber strips 13 inside the cover skirt 2*d* are held against the bottom of the spa cover 2 and lift the stowage-side of the cover stack 2 during uncovering and covering. The stowage-side end of the side plates 3 are attached with ⅜"×1¼" stainless carriage bolts 15 to the stowage-side lever arms 6. The center-side of the side plates 3 are attached to the fold-side lever arms 5 and the cross bar 1 with ⅜"×2" stainless hex bolts 16 into the cross bar 1 glued ⅜" coupler inserts 11.
4. Two Fold-side Lever Arms 5—½"×2"×36" power-coated aluminum bars that rotate the center, fold-side of the cover stack 2 up off the spa 17 as the opening sequence commences, and keeps the cover stack 2 clear of the stowage-side upper lip 17*a* of the spa 17 during the opening and closing, until the cover stack 2 is returned to the top of the spa 17 at the completion of the closing operation. Two springs 8*a* and 8*b* pull on either side of each fold-side lever arm 5 to counteract the weight of the cover stack 2 during opening and closing.
5. Two Stowage-side Lever Arms 6—½"×2"×18" powder-coated aluminum bars that rotate the stowage-side of the cover stack 2 up off the spa 17 as the open sequence commences, and keep the cover stack 2 clear of the stowage-side upper lip 17*a* of the spa 17 during the opening and closing, until the cover stack 2 is returned to contact with the top of the spa 17 at the completion of the closing operation.
6. Two Inner Mounting Plates 7—0.08"×16"×36" aluminum plates that attach with fourteen #10×1¼" stainless steel screws to each side of the spa 17. The inner mounting plates 7 are dimpled to flushly affix the three ⅜"×2" stainless steel carriage bolts 20 used as the pivot points for the fold-side 5 and stowage-side 6 lever arms, and a to anchor the spring swivels 9. Additional dimples flushly affix four #10×2" stainless steel bolts 21 to attach the outer mounting plates 10.
7. Four Springs 8—Two 1"×10" steel springs 8 with ten pounds per inch tension are used on each side to counter-balance the weight of the cover stack 2 during opening and closing. The two springs 8 pull in opposite directions on the fold-side lever arms 5. One spring 8*b* is anchored at the other end to the end of the stowage-side lever arm 6. And one spring 8*a* is anchored at the other end through a swivel 9 and a ⅜"×2" stainless steel carriage bolt 20 to the inner mounting plate 7. The springs 8*a* and 8*b* are positioned to start tension as the folded cover stack 2 lifts to a neutral, balanced position, then provide increased opposing tension to counteract the weight of the cover stack 2 as it lowers over the side of the spa 17. As the cover stack 2 reaches its stowage position, the springs 8*a* and 8*b* are fully extended, but counter-pull on the fold-side lever arms 5 at such an acute angle so as to reduce their effectiveness and allow the cover stack 2 to park securely in its stowage position below the upper edge of the spa 17*a*. Yet the slightest lift of the stowed cover stack 2 returns the springs 8*a* and 8*b* immediately to a more efficient counter-pull angle with the fold-side lever arms 5, and counter balance the weight of the cover stack 2, allowing an effortless return of the cover 2 to the closed position.
8. Two Spring Swivels 9—A 0.08"×5"×1" U-folded swivel 9 that connects the fold-side springs 8*a* to the fold-side spring ⅜" anchor bolt 20 to allow each fold-side spring 8*a* to swivel down when in the unloaded closed position.
9. Two Outer Mounting Plates 10—0.08"×16"×36" powder-coated aluminum plates 10 that attach with ⅜" stainless nylon lock nuts 22 to the three ⅜" bolts 20 and spacer ⅜" stainless nuts 18, and with four #10 stainless nylon lock nuts 24 to the four #10×2" bolts 21 and spacer #10 stainless nuts 23 on the outside of each side assembly to cover the spring 8*a* and 8*b* mechanisms for safety and a cleaner appearance, and to reinforce the lever arm 5 and 6 pivot points and spring swivel 9 anchor.

Figure 3A:
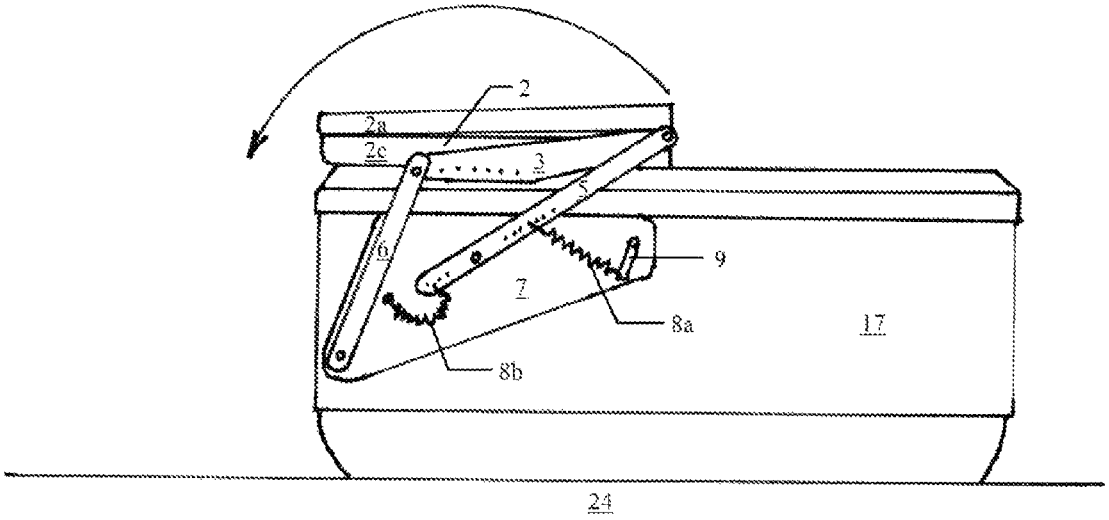
FIGS. 3(A)-3(B) are two side views of an implementation of a spa cover lifter with inclined adjacent stowage according to present principles, in the folded and open positions.
Figure 3B:
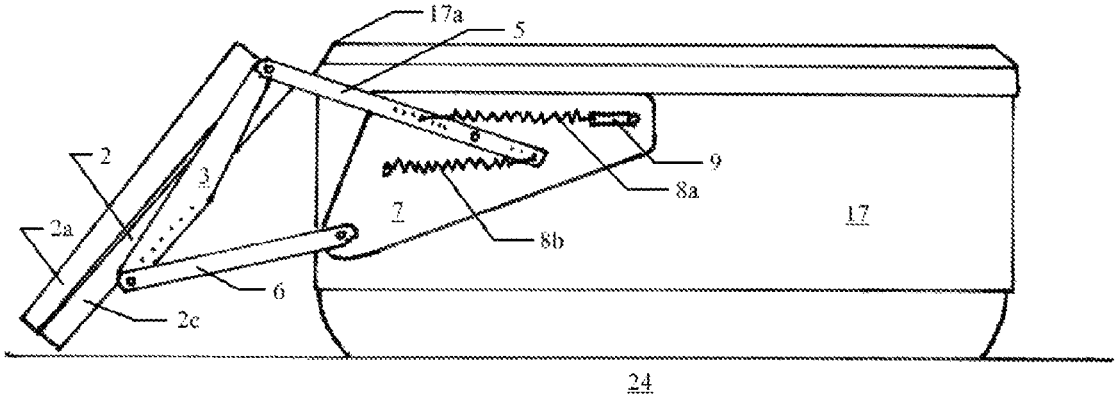

FIGS. 3(A)-3(B) are two side views of a spa 17 with spa cover lifting mechanism that stores a single-fold cover 2 in an inclined adjacent position, in the folded and open positions, shown with the outer mounting plates removed.

In a specific implementation of the system of FIG. 3, an initial design requires that, if it is not possible to stow the folded cover stack 2 vertically adjacent and partially below the top edge of the pad as in FIG. 2, e.g. if the spa 7 is on a continuous pad 24—then the stowage-side lever arm 6 can be lengthened to 25.9" (24.4" hole-hole) and stowage-side lever arm 6 pivot moved downward 5" so the folded cover stack 2 is maneuvered into an inclined position on the cover stowage end, so as to be still below the top of the spa 17*a*. Increased clearance on the cover stowage end will be required (about 3' for a 7' spa), but that is often not a problem with a free-standing spa 17.

Figure 4A:
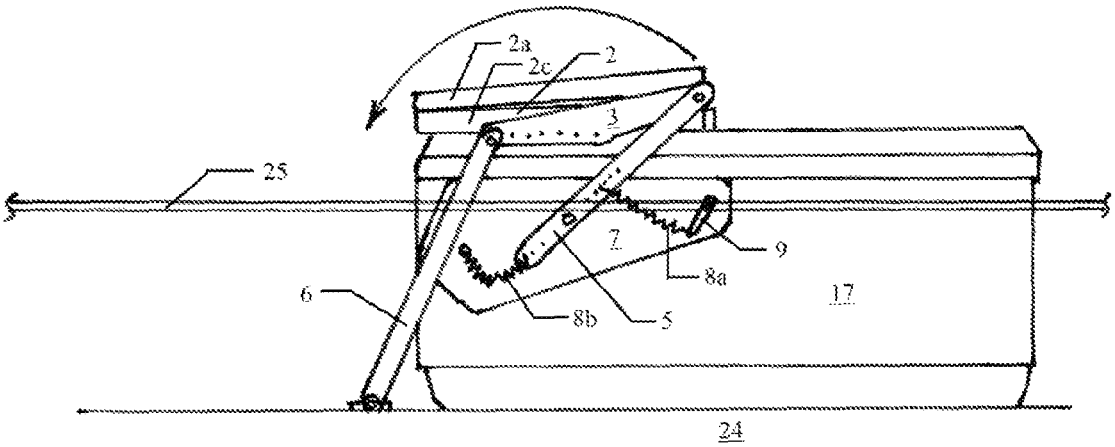
FIGS. 4(A) and 4(B) are two side views of another implementation of a spa cover lifter with stowage horizontally on a raised deck according to present principles shown in the folded (A) and open (B) positions.
Figure 4B:
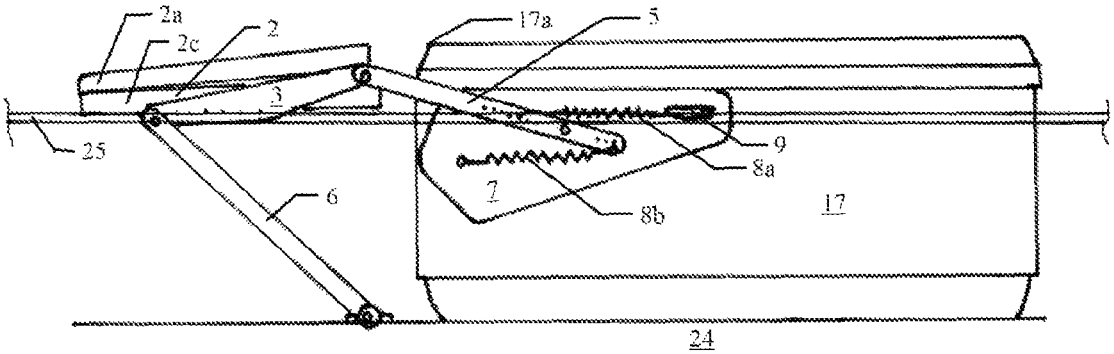

FIG. 4 shows a configuration for environments where the spa 17 is situated surrounded by a raised deck 25. Accordingly, in this implementation the spa cover is stowed flat and yet still adjacent to and below the top edge of the spa. The same may still be folded, in either a single-fold or a double-fold configuration. FIGS. 4(A) and 4(B) show the spa cover lifting mechanism in the folded (A) and open (B) positions, and in particular with the outer mounting plates removed.

In more detail, in this implementation, the spa cover lift mechanism stores the folded cover stack 2 below the top of the spa 17 flat above or on a surrounding raised deck 25 for any built-in spa 17 that protrudes at least the depth of the cover stack 2 above the surrounding deck 25 and has room for a flat cover stack 2 on the stowage side. This is preferable to just sliding the folded cover 2 onto supports, a shelf or deck because the spa cover lift mechanism helps lift and guide the heavy cover stack 2 between closed and open positions, and the lip of the spa and the bottom of the spa cover are not damaged by rubbing during dragging.

In a very specific implementation of this "Flat Folded Adaptation", the same may be especially for use with spas 17 that are built-in, or have a raised surrounding deck 25, if the deck 25 on the stowage side of the spa 17 is at least as far below the top edge of the spa 17*a* as the thickness of the cover stack 2 (about 10"), the stowage-side lever arms 6 can be lengthened to 41.5" (40" hole-hole) and attached to the spa pad 24 6.5" out from the stowage side of the spa 17 to store the cover stack 2 below the top edge 17*a* of the spa 17 in a near-horizontal position. The stowage side spring 8*b* would be anchored on the stowage side with a stainless steel ⅜" bolt 20 mounted between the inner 7 and outer 10 mounting plates. 1" slots would be required in the raised deck 25 to allow the lever arms 5 and 6 to pass. Flat stowage requires about 50" horizontal clearance on the stowage side of the spa 17 for a single-folded cover 2.

Figure 5:
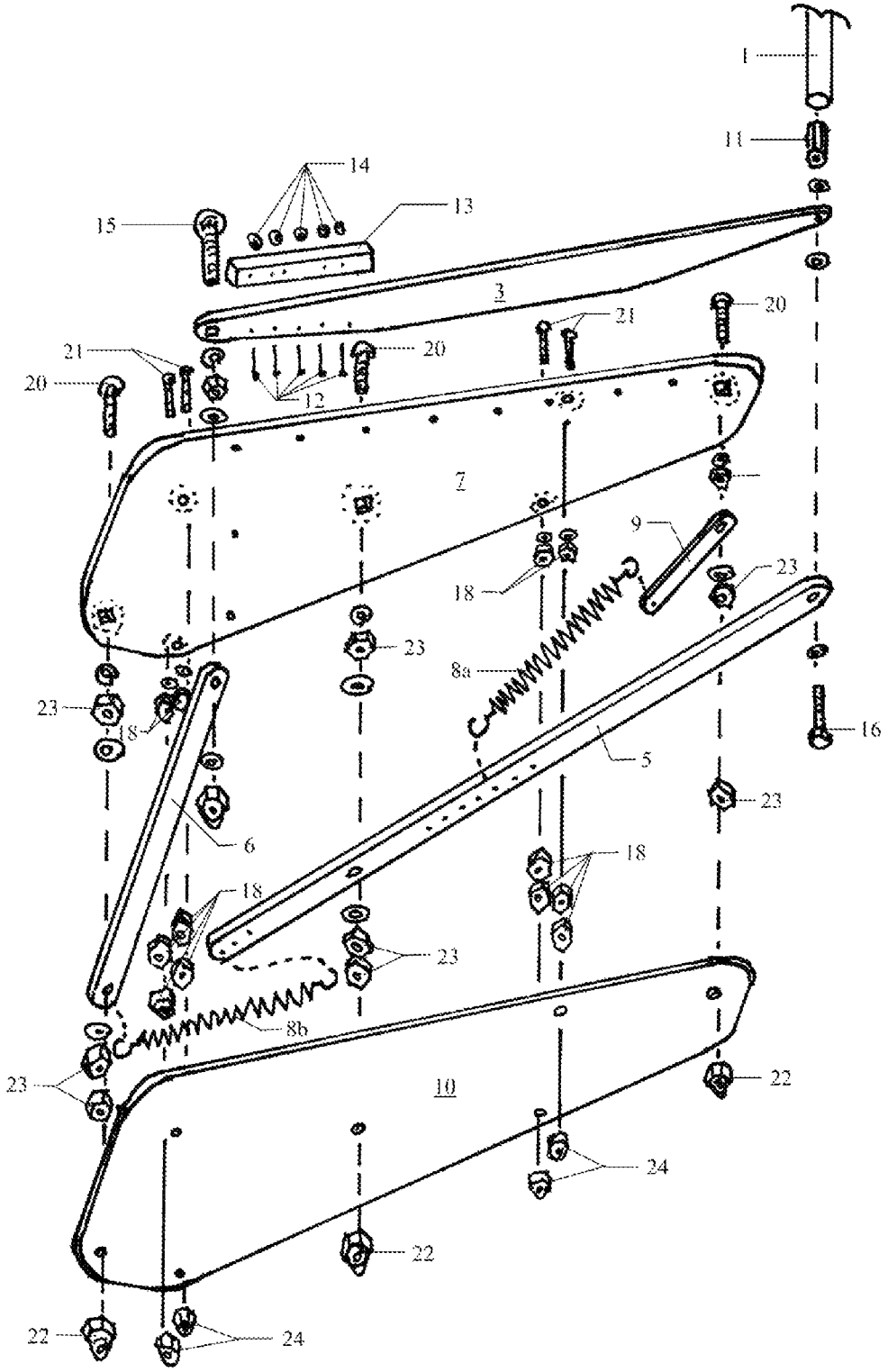
FIG. 5 is an exploded view of an implementation of the spa cover lifting mechanism according to present principles.

FIG. 5 is an exploded view of the single-fold cover vertical adjacent stowage spa cover lifting mechanism.

Figure 6:
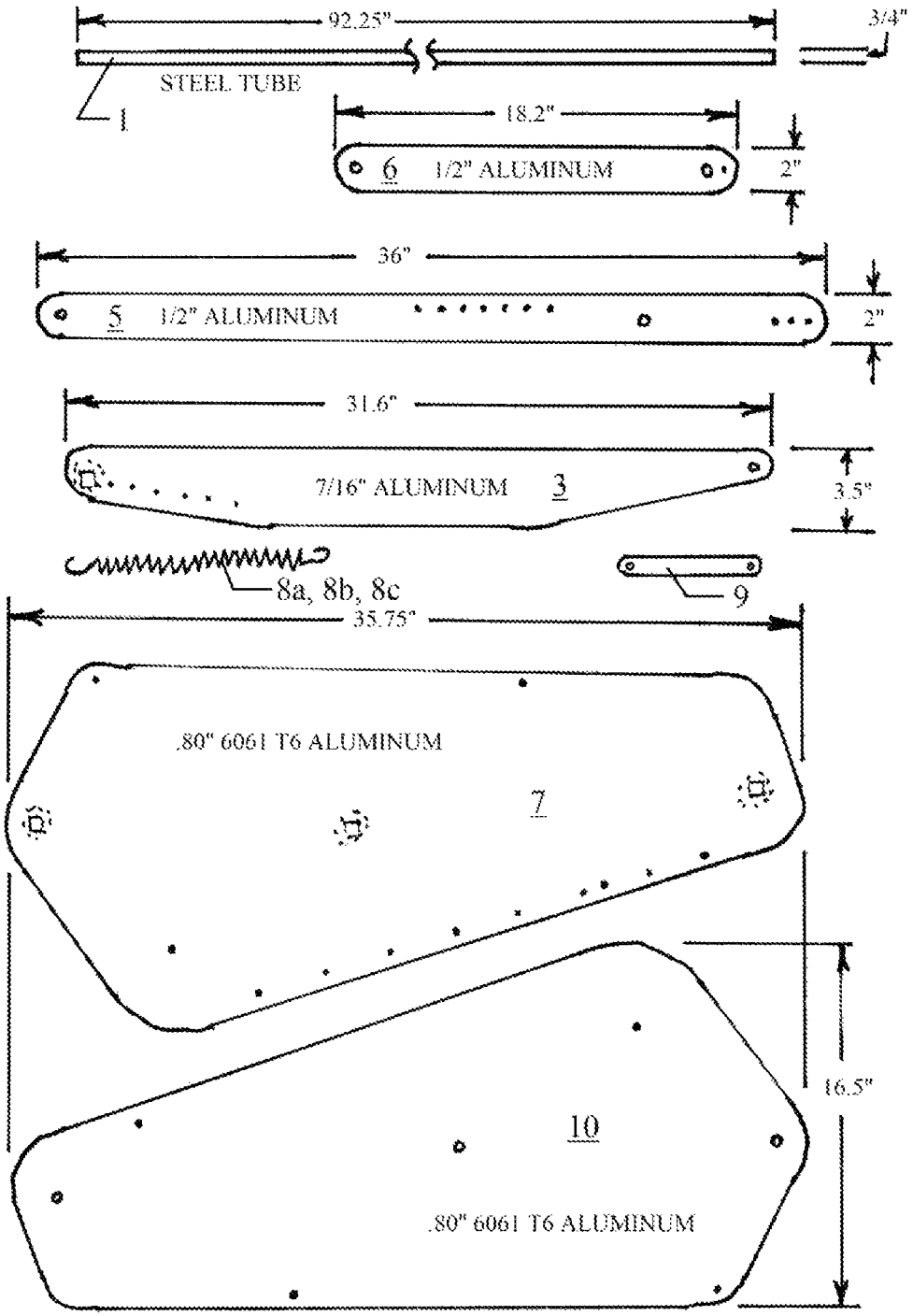
FIG. 6 is a parts diagram of a spa cover lifting mechanism according to present principles.

FIG. 6 is a parts diagram of the spa cover lifter components, in this implementation from a Jacuzzi® model J-365 with vertical adjacent stowage configuration. It will be understood that other spa models may have similar components, appropriately-sized.

Figure 7A:
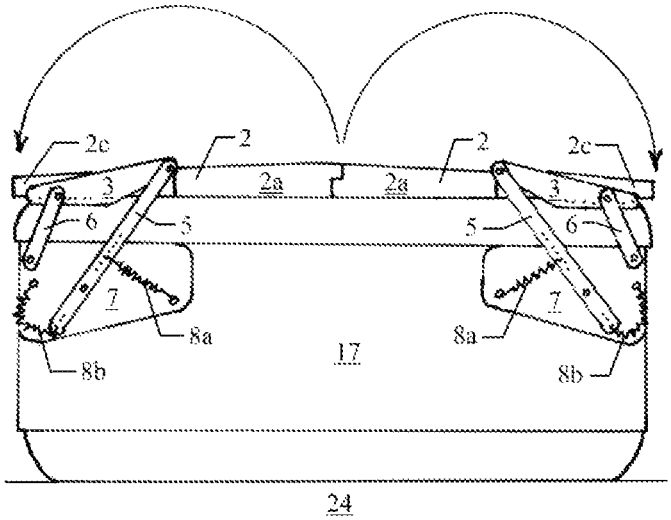
FIGS. 7(A)-7(C) are three side views of an implementation of the spa cover lifting mechanism with a split top and vertical adjacent stowage according to present principles.
Figure 7B:
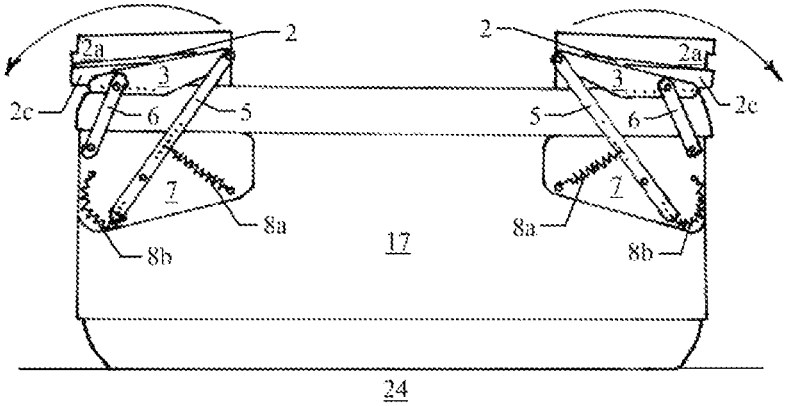
Figure 7C:
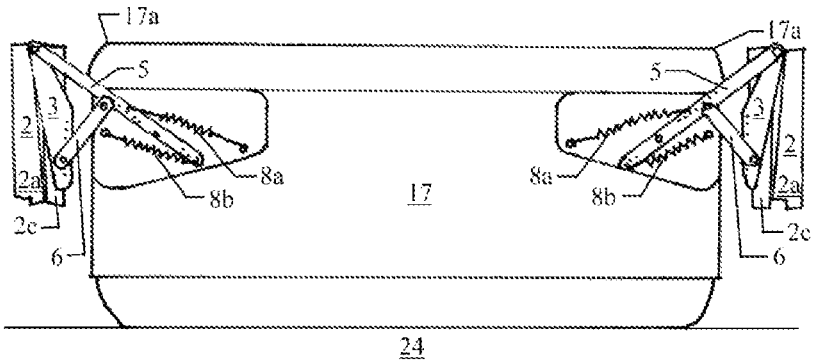

FIGS. 7(A)-7(C) are three side views of a spa with spa cover lifting mechanisms on both sides stowing each half of a split-fold cover vertically adjacent to the spa, in the closed, covers folded, and open positions—shown with the outer mounting plates removed. Element numbers are similar to those in prior figures, but in this implementation the spa cover is divided into two portions, each with a single-fold or monofold configuration, and thus two sections 2*a* and 2*c*. FIGS. 7(A)-7(C) show sequential steps in removing the cover from the spa. The spa can be uncovered from either outside the spa, or, with a single inner panel 2*a* open, from inside the spa.

In this implementation, termed a split-folded cover, the spa cover 2 is split in the middle with each half configured to fold toward the sides of the spa, providing a folded cover stack on each side with a vertical height only about one quarter of the spa 17 width perpendicular to the stowage sides. This mechanism, sized for such a cover, would allow each folded cover half to disappear below the top edge of the spa 17*a*, vertically adjacent to the stowage sides, or stored in an inclined position or flat if less stowage height is available.

In a split-folded cover adaption implementation, and referring again to FIG. 7, if the spa 17 should have a cover 2 split in the middle with each half able to fold toward the sides of the spa 17, this would provide a folded cover stack 2 on each side with a vertical height only about one quarter of the spa 17 width perpendicular to the stowage sides. Side plates 3 may be, e.g., 20"×3.5" (15.5" hole-hole). Stowage-side lever arms 6 may be, e.g., 10.5" (9" hole-hole) and fold-side lever arms 5 may be, e.g., 26.5" (19" hole-hole). The mechanism shown would allow each folded cover half 2*a* and 2*c* to disappear below the top edge of the spa 17*a*, vertically adjacent to the stowage sides, or stored in an inclined position (see FIG. 3) if less stowage height is available.

Figure 8A:
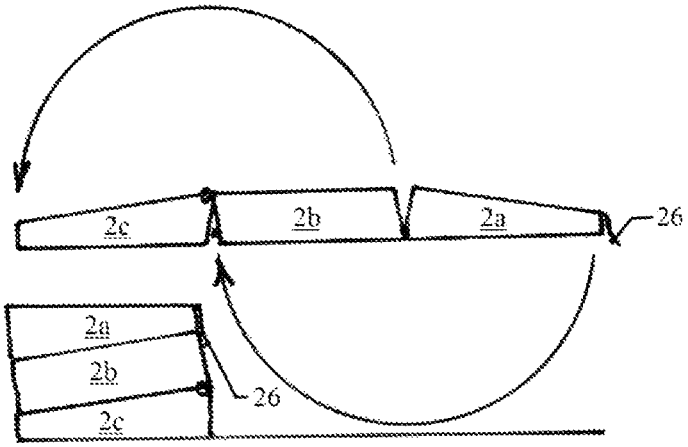
FIGS. 8(A)-8(B) shows the folding pattern of two double-fold covers.
Figure 8B:
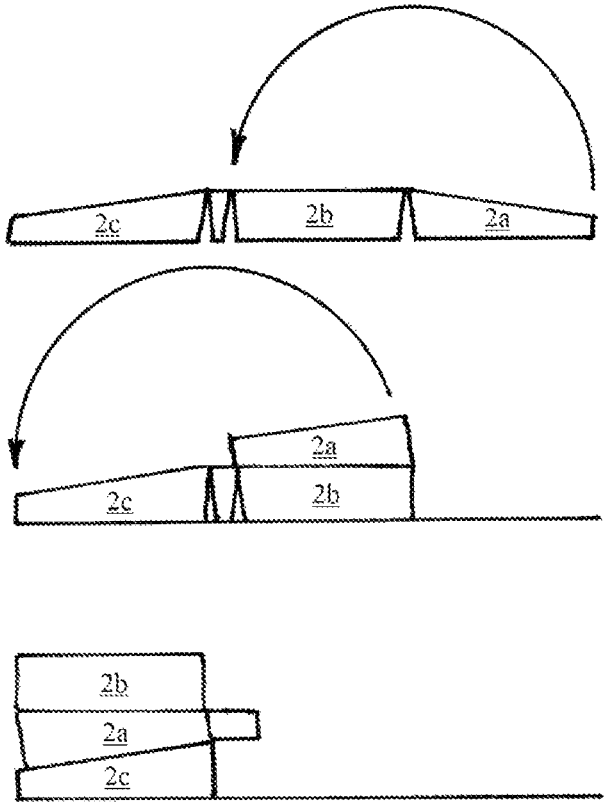
Figure 9A:
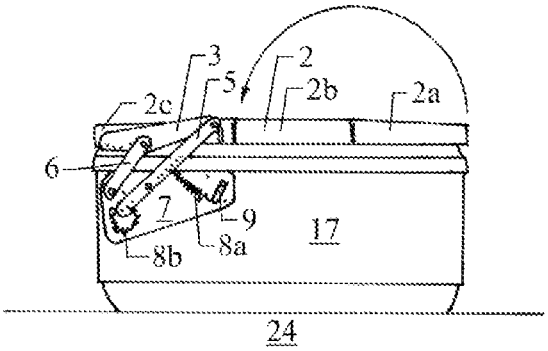
FIGS. 9(A)-9(D) are four side views of an implementation of the spa cover lifting mechanism with a double-fold cover and vertical adjacent stowage according to present principles.
Figure 9B:
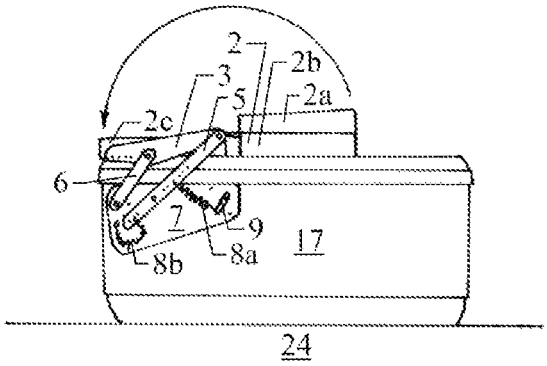
Figure 9C:
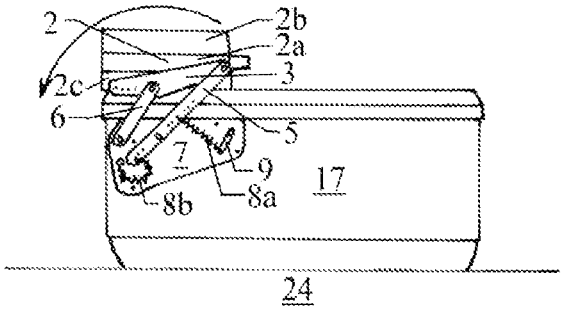
Figure 9D:
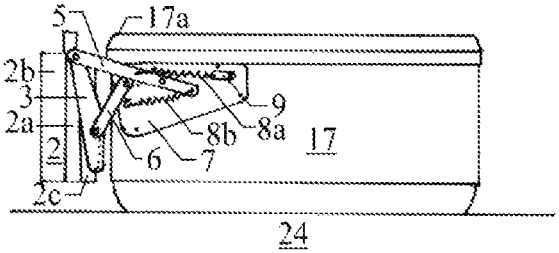

As noted above, spa covers may be configured having monofolds or bifolds, also termed "single-fold" or "double-fold", respectively. FIGS. 8(A)-8(B) show the folding pattern of two double-fold covers. FIG. 8(A) shows a "Z" type double-fold cover. FIG. 8(B) shows a roll type double-fold cover.

In a specific implementation of the double-folded cover adaptation as in FIG. 8, the same may work particularly with a spa cover 2 that has two folds for a triple stack when folded. This type spa cover 2 could fold once then again in a rolling motion FIG. 8(B), or it could fold in a "Z" pattern FIG. 8(A). A "Z" pattern fold would require a fastener 26 or imbedded magnets to hold the folded cover stack closed during cover stack 2 opening and closing. Either way would allow the folded cover stack 2 height when stowed to be only a third of the spa 17 width perpendicular to the stowage side, which would usually be less than the spa 17 height, allowing the double-folded cover stack 2 to disappear below the top edge of the spa 17*a*, and store vertically adjacent to the spa 17. Side plates 3 would be 24"×3.5" and 17" hole-hole. Fold-side swing arms 5 would be 29.5" long with 7.7" spring to pivot, and 20.7" pivot to cross bar 1. Stowage-side swing arms 6 would be 13.5" long, 11.7" hole-hole. These cover stacks 2 could also be stowed in an inclined position as in FIG. 3 if less stowage height is available.

FIGS. 9(A)-9(D) are four side views of a spa with a spa cover lifting mechanism stowing a double-fold roll-type cover in a vertical adjacent position, in the closed, first fold, folded, and open positions—shown with the outer mounting plates removed. Element numbers are analogous to those noted above. This implementation includes a spa cover 2 with three sections 2*a*, 2*b*, and 2*c*, i.e., first fold, middle fold, and final fold cover sections.

This implementation is particularly appropriate for a spa cover that has two folds, and thus folds to a triple stack. Such a spa cover could fold once then again in a rolling motion, or it could fold in a "Z" pattern. Either way would allow the folded cover stack 2 height when stowed to be only a third of the spa 17 width perpendicular to the stowage side, which would usually be less than the spa 17 height, allowing the double-folded cover stack 2 to be stored vertically adjacent to the spa 17, or stored in an inclined position or flat if less stowage height is available.

Figure 10:
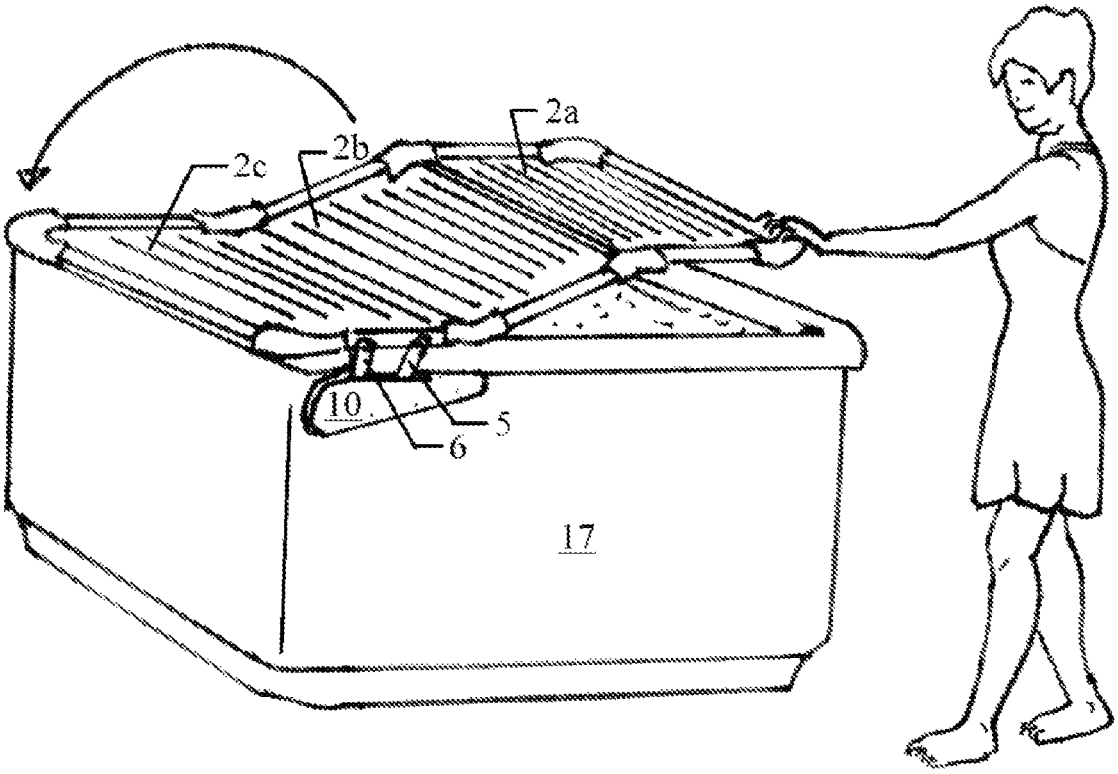
FIG. 10 shows the level lift attitude of the first segment of a Z-fold double-fold cover when assisted by torsion bars along the hinge lines.
Figure 11:
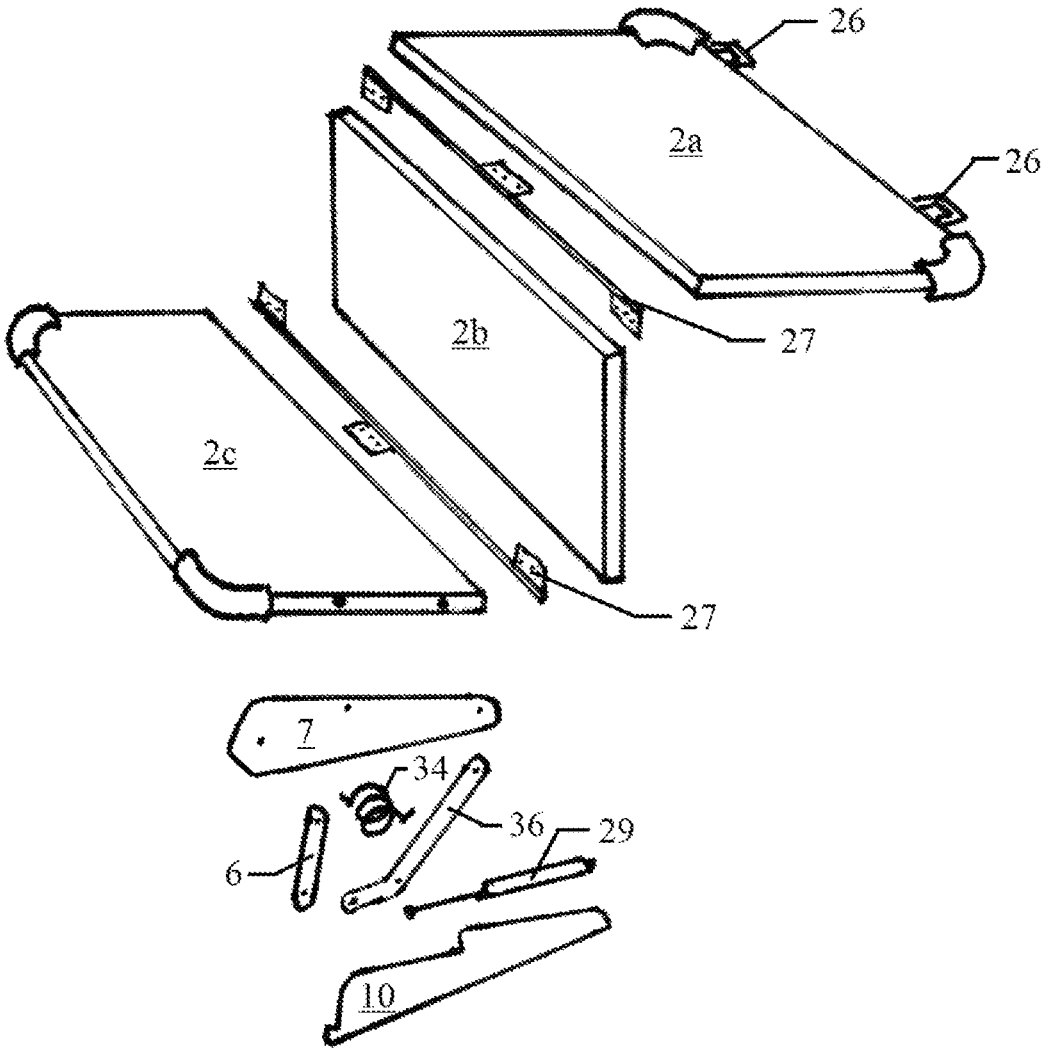
FIG. 11 is an exploded view of a Z-fold double-fold cover with torsion bars, torsion springs, and air-struts according to present principles.

FIG. 10 shows a level lift attitude of the first segment of a Z-fold double-folded cover when assisted by torsion bars along the hinge lines, termed an "assisted open and fold". Referring to FIG. 10 and FIG. 11, with a Z-fold double-folding cover, torsion bars 27 in the hinge lines make the first lifted segment of the cover 2*a* tend to stay level as the second cover segment 2*b* pivots up and over the lowest cover segment 2*c*. The same torsion bars 27 also cushion the cover as it lowers to the fully folded position, or on the reverse as it unfolds and closes. Bent fold-side lever arms 36 allow over-center air-struts 29, and/or torsion springs 34 in the fold-side lever arms 36 pivot point to reduce the apparent weight of the folded cover stack 2. This can be especially helpful with a solid or heavier cover.

FIG. 11 illustrates additional details, in an exploded view, of a Z-fold double-folded cover with torsion bars 27, torsion springs 34, bent fold-side lever arms 36, and air-struts 29. In particular, spa cover sections 2*a*, 2*b*, and 2*c* are shown hingedly attached by torsion bars 27. Fasteners 26 are also shown to lock the folded cover stack 2 together so that it does not unfold during the opening or closing process as the cover stack 2 is raised off the spa 17 and lowered over the side, and when it is returned to the top of the spa 2 during closing. Imbedded magnets could be used in place of the fasteners 26 to hold the Z-fold cover stack together.

In a specification implementation of the Z-fold double-fold cover adaption of FIGS. 10 and 11, torsion bars 27 along the hinge lines can help the first opening cover segment 2*a* tend to stay level as the second cover segment 2*b* pivots up and over the third cover segment 2*c*. This also assists with folding the cover 2 by making it feel lighter.

In the following FIGS. 12, 13, and 14, instead of using a cross bar 1 across the hinge line of the cover 2, and side plates 3 connecting the tops of the lever arms 5 and 6 to the bottom section of the cover 2*c*, the top of the lever arms 5 and 6 could be bolted directly to nut plates 28 molded into the bottom section 2*c* of the cover stack, or to bolt plates 43 glued to the side of the cover 2*c*. This implementation tends to simplify the mechanism, and by varying position of the nut plates 28 in the cover, allow the cover lifting mechanism to fit different size spa covers.

Figure 12:
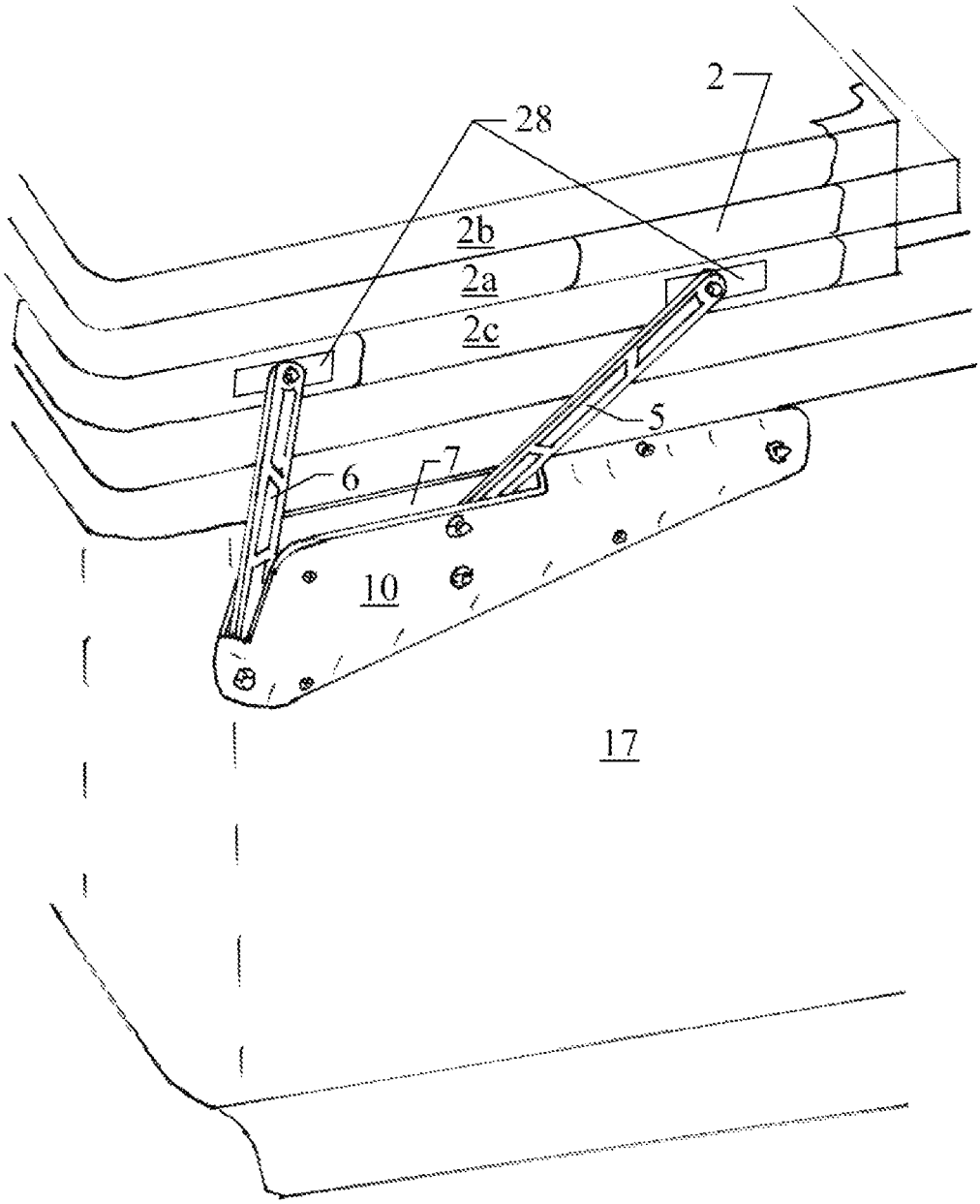
FIG. 12 is a perspective view of an implementation of the spa cover lifting mechanism made from injection-molded plastic, with lever arms bolted directly to nut plates imbedded in the sides of the lowest cover segment according to present principles.

Referring first to FIG. 12, the same shows a perspective view of a spa cover lifter, made from injection-molded plastic, with lever arms 5 and 6 bolted directly to nut plates 28 imbedded in the sides of the lowest cover segment 2*c*.

Figure 13A:
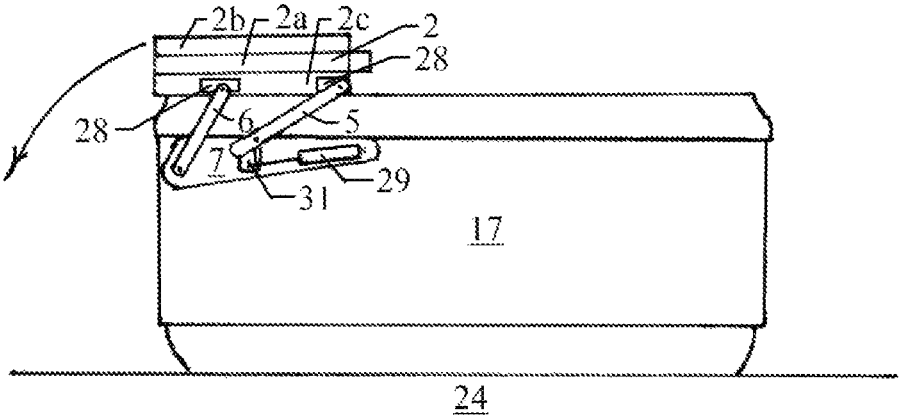
FIGS. 13(A)-13(C) are three side views of an implementation of the spa cover lifting mechanism with a double-fold cover, imbedded nut plates, and air-struts according to present principles.
Figure 13B:
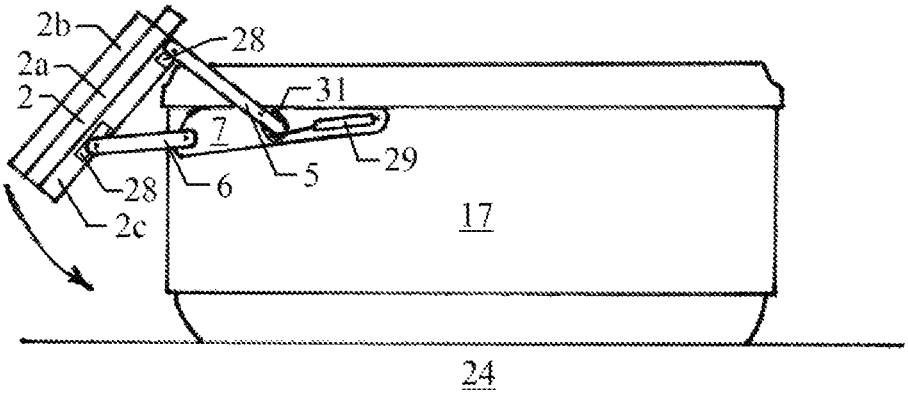
Figure 13C:
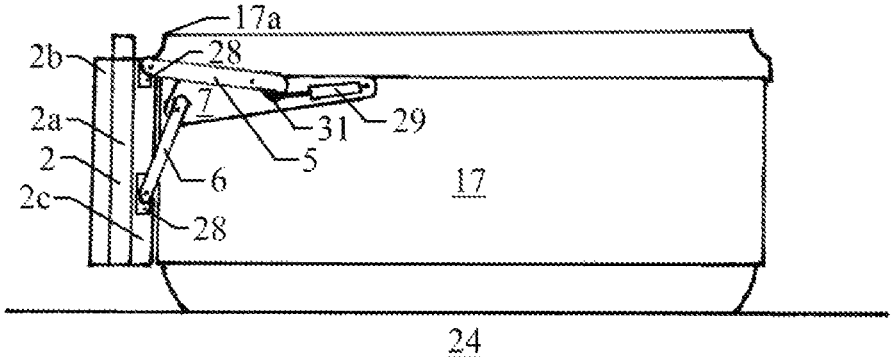

FIGS. 13(A)-13(C) provide three side views in various phases of deployment/removal of a spa 17 with spa cover lifting mechanism stowing a double-fold cover 2 vertically adjacent to the spa, with pivot arms 5 and 6 bolted directly to nut plates 28 situated in the cover 2*c*, and further using an air-strut 29 attached to a swivel bracket 31 on each side to compensate for cover weight. The figures show various stages or phases, e.g., in the closed, cover folded, and open position—shown with the outer mounting plates removed.

Figure 14:
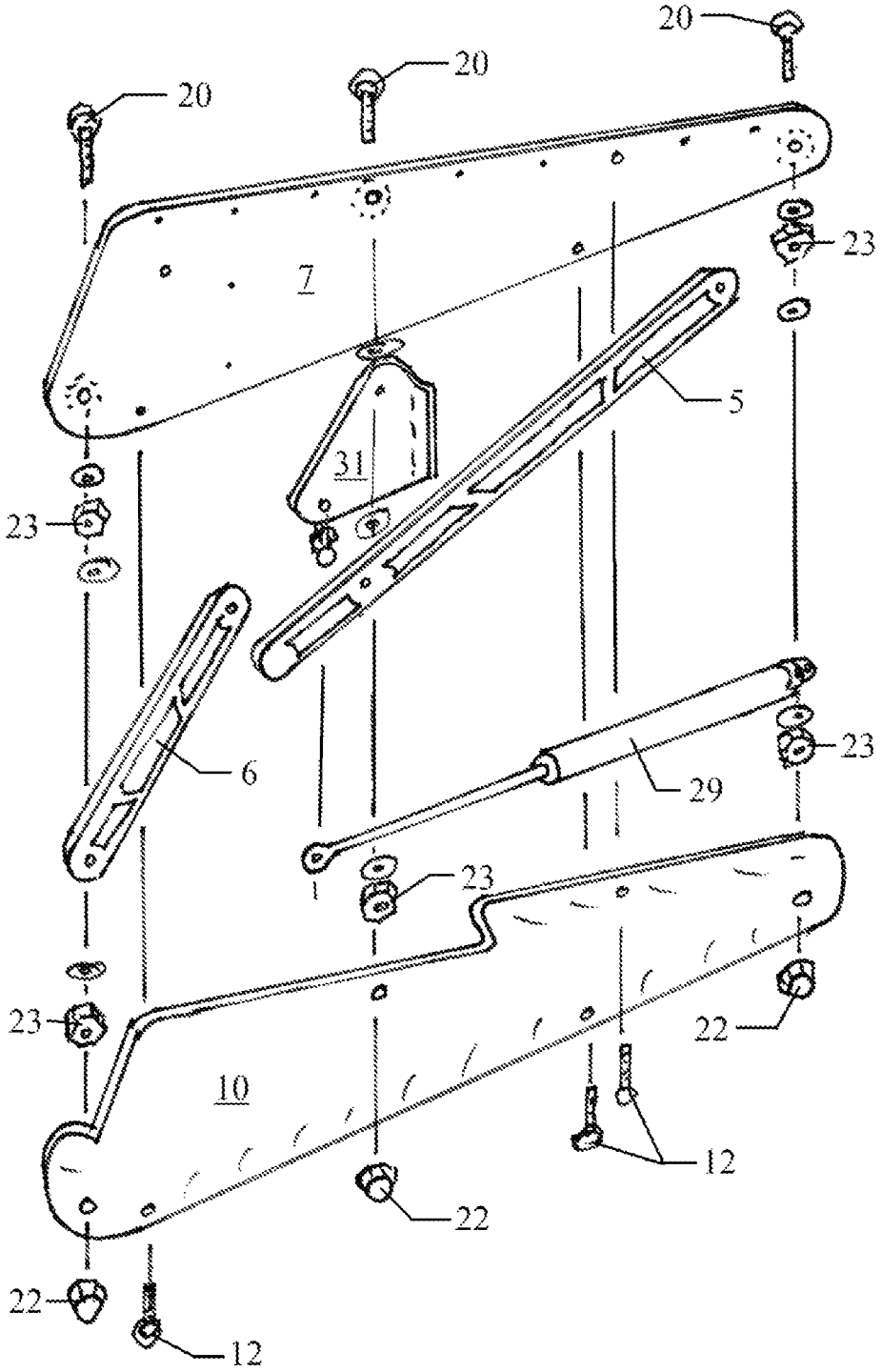
FIG. 14 is an exploded view of an implementation of the spa cover lifting mechanism made from injection-molded plastic, with an air-strut and swivel bracket according to present principles.

In FIGS. 12, 13 and 14, instead of using a cross bar 1 trapped in the cover 2 hinge line and side plates 3, the cover end of the lever arms 5 and 6 can be attached directly to the lowest section of the folded cover 2*c* with bolts into nut plates 28 molded into the cover, or with nuts on bolt plates 43 glued to the outside of the cover 2*c*. This would shorten the fold-side lever arms 5, making the mechanism more clean and compact. Swivel bracket 31 rotates on the fold-side lever arm 5 pivot, connected to the air-strut 29, delaying compression of the air-strut 29 during opening until the raised edge of the swivel bracket 31 engages the fold-side lever arm 5 as the cover stack 2 is passing the balance point and weight counter-balance is needed. In a similar fashion, the air-strut 29 helps lift the cover stack 2 out of the stowed position, and up and over the spa 17, until the cover stack goes past the balance point, at which point the swivel bracket 31 disengages from the storage-side lever arm 5 and the air-strut 29 stops pushing.

Referring next to FIG. 14, an exploded view is seen of a spa cover lifter made from injection-molded plastic, with an air-strut. In this implementation, instead of springs 8*a* and 8*b*, air-struts 29 can be incorporated in compression with swivel brackets 31 to assist in lifting the cover 2 into and out of the stowed position.

This figure also shows additional details of an implementation, including how the inner mounting plate 7 is coupled to the outer mounting plate 10, and how the lift mechanism components are disposed between the mounting plates, using: ⅜"×2" stainless steel carriage bolts 20, ⅜" stainless nylon lock nuts 22, ⅜" stainless nuts 23, and #20×1.75" stainless bolts 12. Swivel brackets 31 that delay the onset of the air-strut power until the cover stack is past the balance point are also shown.

Figure 15A:
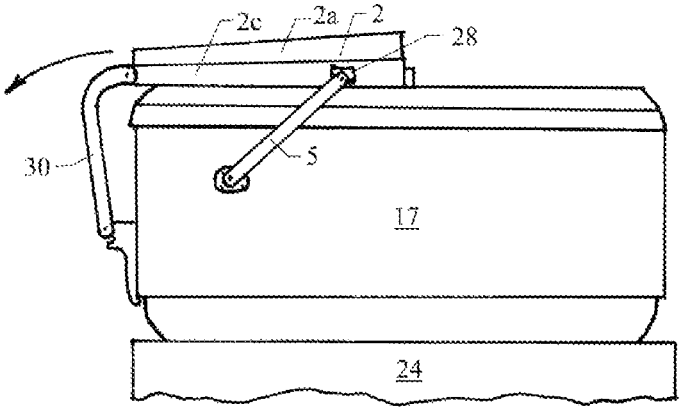
FIGS. 15(A)-15(C) are three side views of an implementation of the spa cover lifting mechanism for a single-fold cover with vertical adjacent stowage partially below the pad according to present principles.
Figure 15B:
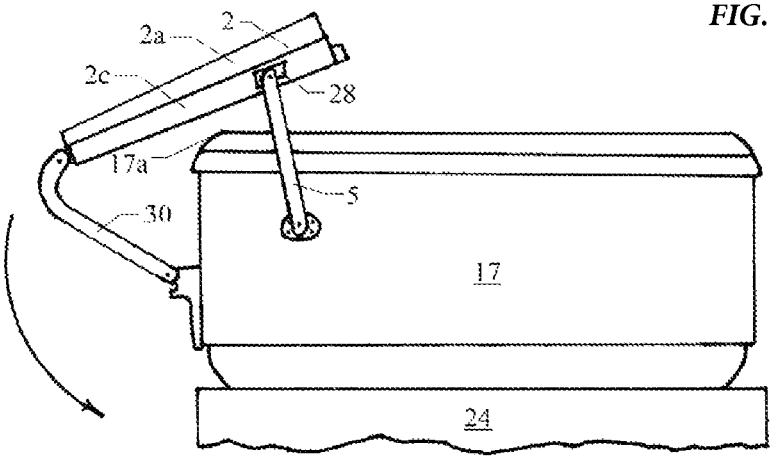
Figure 15C:
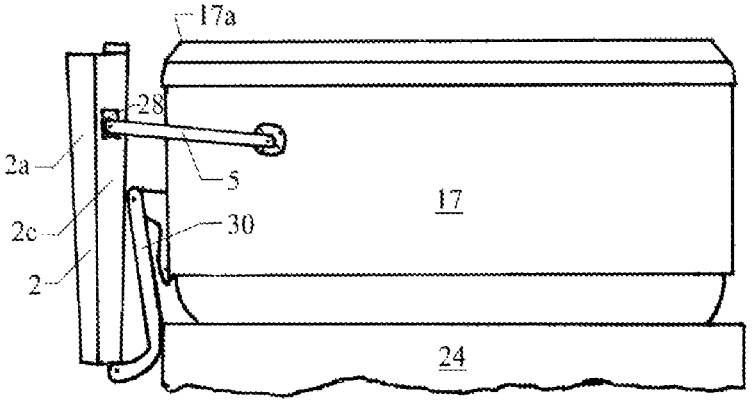

FIGS. 15(A)-15(C) are three side views of a spa 17 with a spa cover lifting mechanism with a single-fold cover stowed vertically adjacent, below the top edge of the spa 17 and partially below the pad 24. This spa cover lifting mechanism uses modified arm lengths and adjusted air-strut length and power, allowing it to stow the cover stack below the top edge of the spa. It has a pivoting swing arm on either side of the spa connecting to nut plates in the lower cover section 2*c* in the stack towards the hinge line, and further includes one or two bent stowage-side swing arms 30 attached to nut plates in the stowage-side edge of the lower spa cover section 2*c* in the stack, and anchored to a bracket attached to the stowage-side of the spa 17 with a weight compensating air-strut(s) (not shown for clarity). The cover is shown in the cover folded, opening, and open positions.

Figure 16A:
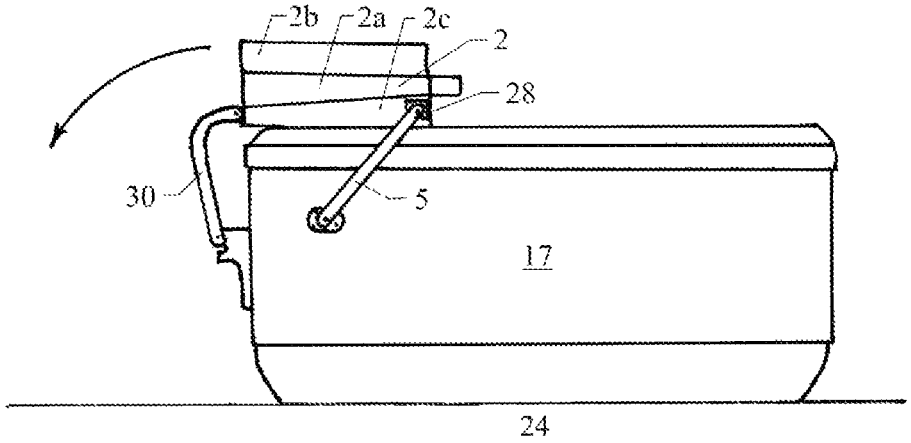
FIGS. 16(A)-16(C) are three side views of an implementation of the spa cover lifting mechanism for a double-fold cover with vertical adjacent stowage according to present principles.
Figure 16B:
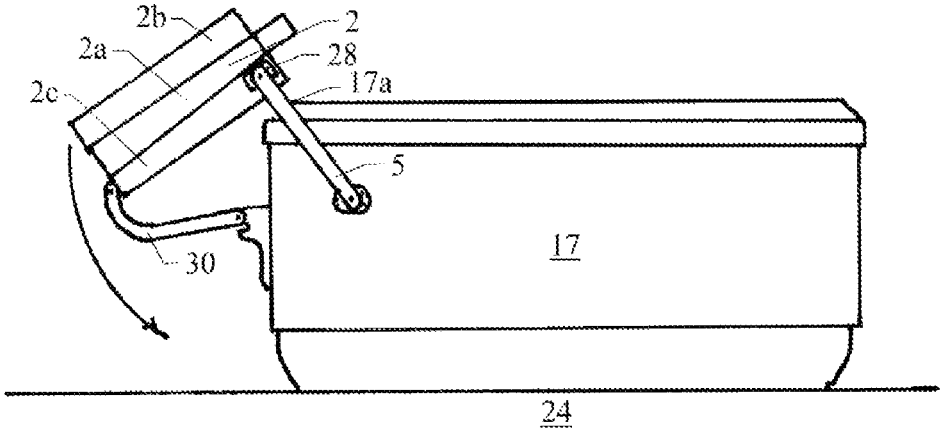
Figure 16C:
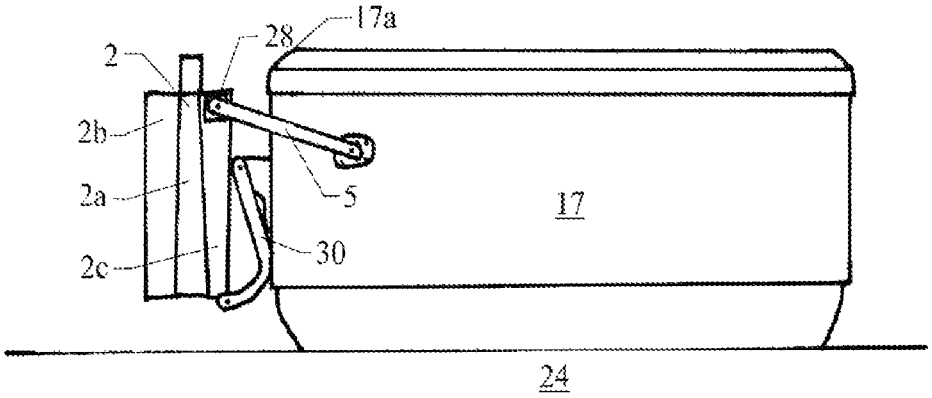
Figure 17A:
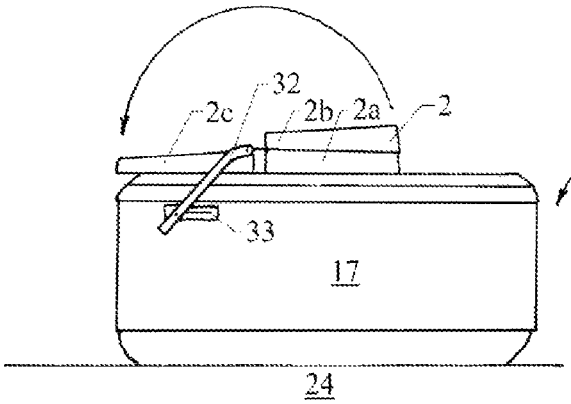
FIGS. 17(A)-17(D) are four views of an implementation of the spa cover lifting mechanism for a double-fold cover with vertical adjacent stowage according to present principles.
Figure 17B:
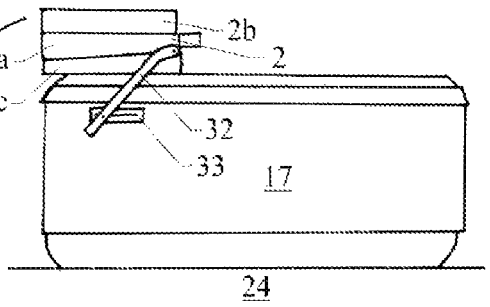
Figure 17C:
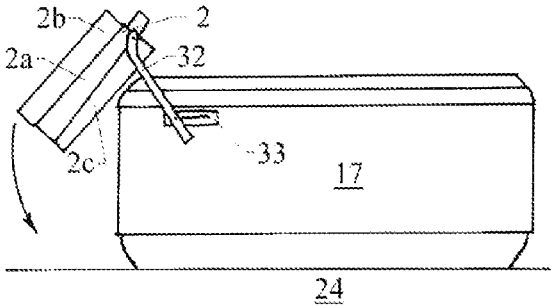
Figure 17D:
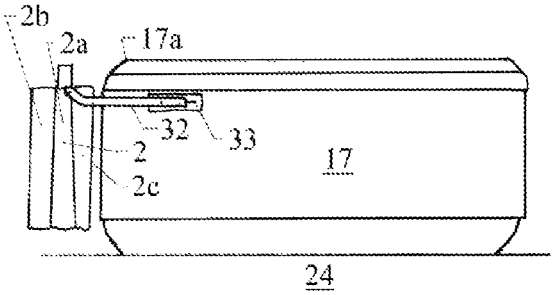

Similarly, FIGS. 16(A)-16(C) are three side views of an adaption of the same spa cover lifting mechanism, this time to stow a double-fold cover vertically adjacent below the top edge of the spa 17. It has a pivoting swing arm 5 on either side of the spa 17 connecting to nut plates 28 in the lowest cover section 2*c* in the stack towards the hinge line, and one or two bent swing arms 30 attached to nut plates in the stowage-side edge of the lowest spa cover section 2*c* in the stack, and anchored to a bracket attached to the stowage-side of the spa with weight compensating air-strut(s). The cover is shown in the folded, opening, and open positions—again shown without the air-strut(s) for clarity.

As may be seen, the implementations of FIGS. 15 and 16 work conveniently with a single or double-folded spa cover 2. The fold-side lever arm 5 on each side attaches to a pivot mounted to the side of the spa, and to a nut plate 28 imbedded in the side edge of the lower section of the folded cover 2*a*, toward the fold. The cross bar 1, side plates 3, outer mounting plates 10, and springs 8*a* and 8*b* are not generally required. One or two bent stowage-side lever arm(s) 30 may be mounted on the stowage side of the spa. The upper end of the arm 30 may be bolted to a pivot attached to imbedded nut plates in the stowage-side edge of the lowest section of the folded cover 2*c*. The lower end of the bent stowage-side lever arm 30 may be attached pivotally to a bracket mounted on the stowage side of the spa, with a weight-compensating air-strut 29. These cover stacks 2 could also be stowed in an inclined position as in FIG. 3 if less stowage height is available.

FIGS. 17(A)-17(D) provide four views of a spa with a spa cover lifting mechanism stowing a double-fold roll-type cover vertically adjacent to the spa. This spa cover lifting mechanism has modified arm lengths that can stow the cover stack below the top edge of the spa. It has a swing arm 32, also termed a "single bent lever arm", anchored at one end on either side of the spa 17 with the other end of the single bent swing arm 32 attached to a cross bar 1 supporting the fold line of the cover stack 2. The cover is shown in the cover first fold, cover folded, opening, and open positions.

The design of FIG. 17 works conveniently with a spa cover 2 that has two folds for a triple stack when folded. This type of spa cover 2 could fold once then again in a rolling motion, or it could fold in a "Z" pattern FIG. 8. A "Z" pattern fold would require a fastener 26 or imbedded magnets to hold the folded cover stack 2 closed during opening and closing. Either way would allow the folded cover stack 2 height when stowed to be only a third of the spa 17 width perpendicular to the stowage side, which would usually be less than the spa 17 height, allowing the double-folded cover stack 2 to seem to disappear below the top edge of the spa 17*a*, and store vertically adjacent to the spa 17. A single bent lever arm 32 on each side may attach to a cross bar 1 supporting the cover 2 fold. The other end of the lever arm 32 would attach to a swivel mechanism on each side of the spa, with a bumper stop 33 when the arm 32 is in the fully open position. These cover stacks 2 could also be stowed in an inclined position as in FIG. 3 if less stowage height is available.

Figure 18A:
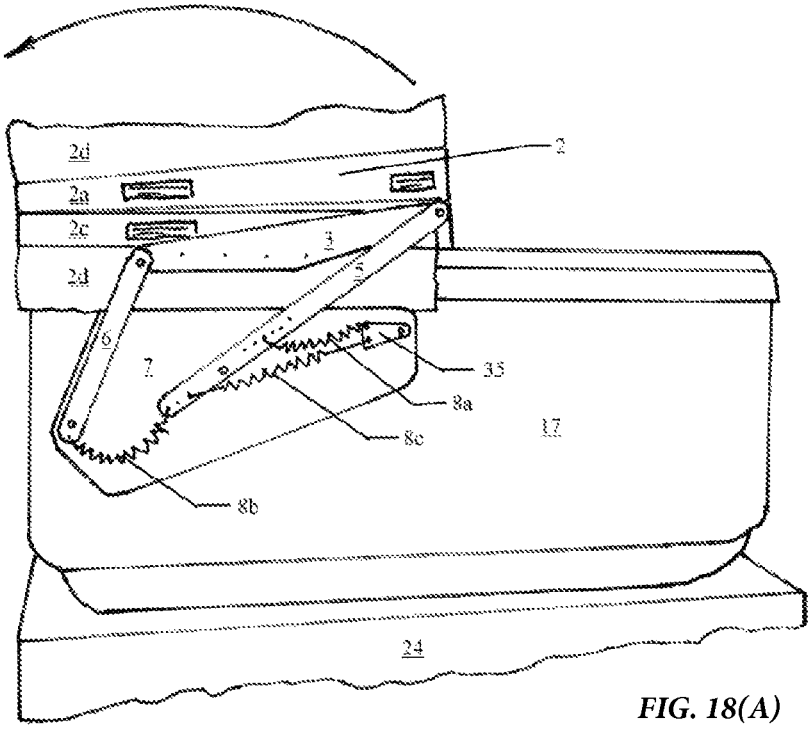
FIG. 18(A)-18(B) are two side views showing two implementation(s) of lift assist springs for the spa cover lifting mechanism.

FIG. 18(A) shows the addition of lift assist springs to a spa cover lifting system, shown with the outer mounting plate removed. These additional springs make the spa cover stack 2 seem lighter during the initial lift off of the top of the spa 17, and results in a more even lift off, and a more cushioned landing when closing. Also shown is a triangular spring swivel 35, which is configured to not only couple to multiple springs but also to rotate and swivel as the cover 2 is removed and deployed.

Figure 18B:
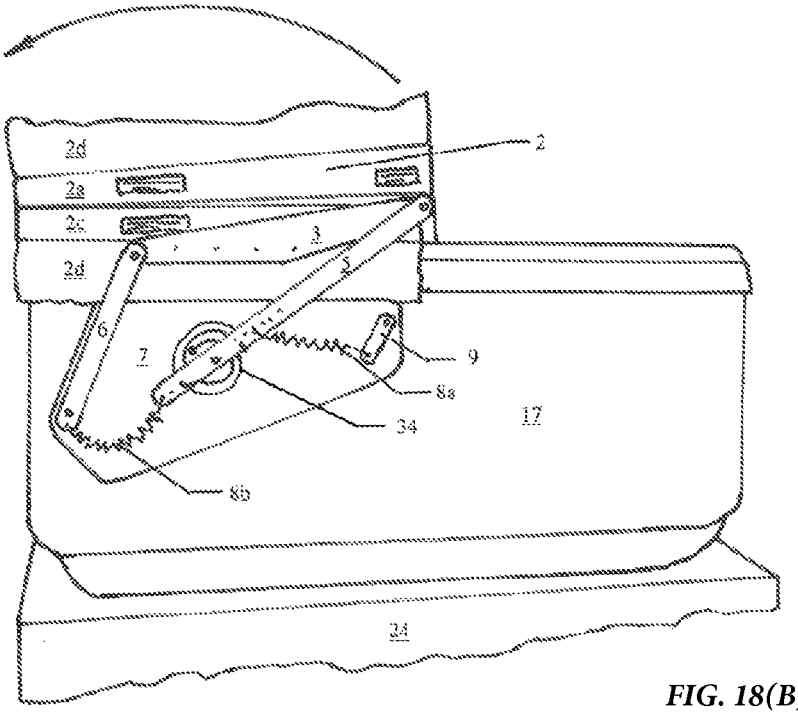

This lift assist could be accomplished instead or in addition with a torsion spring 34 on the pivot of the fold-side swing arm 5, as shown in FIG. 18(B). This torsion spring 34 would make the spa cover 2 feel lighter, and will make the cover stack 2 lift off the spa 17 more evenly.

Figure 19A:
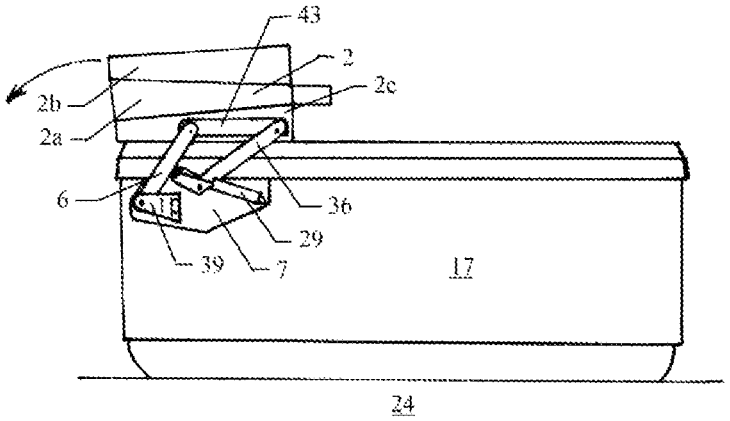
FIGS. 19(A)-19(C) are three side views of an implementation of a more compact spa cover lifting mechanism incorporating a bent pivot arm allowing the air-strut to swing past the pivot point when closing according to present principles.
Figure 19B:
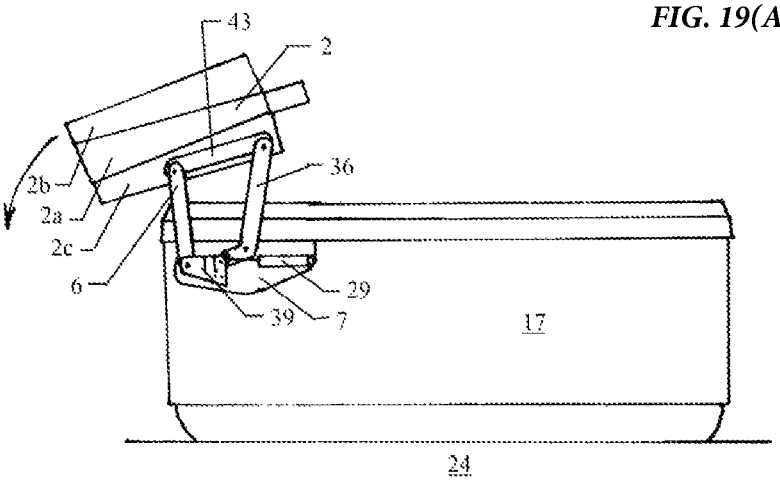
Figure 19C:
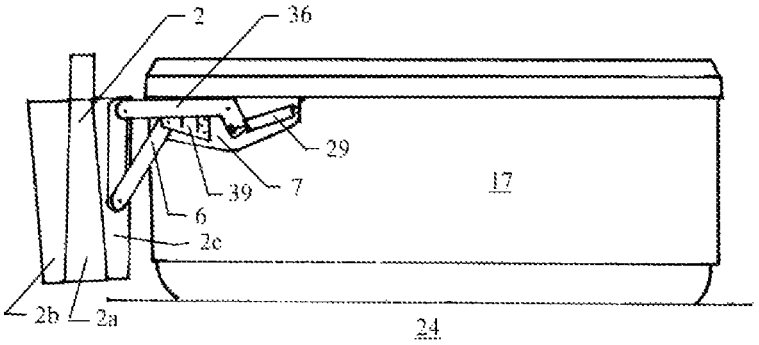

FIGS. 19(A)-19(C) shows incorporation of a bent fold-side pivot arm 36 allowing the air-strut 29 to swing past the pivot point and start re-compressing when closing, shown with the outer mounting plate removed. As the air-strut 29 is compressed, it provides cushioning to the cover stack 2 as it lowers onto the top of the spa 17. The slightly compressed air-strut 29 also provides initial lift assist when the cover stack 2 is initially lifted off of the spa 17 when opening.

FIG. 18A illustrate relaxed springs 8*a* and 8*b* in the spa-closed position to offer a secure thermal seal of the spa cover 2, ensure the spa cover 2 does not lift in high winds, and further to resist young children from gaining access to the uncovered spa 17. Normal adults can easily open the spa 17. But additional springs 8*c*, torsion springs 34 and/or torsion bars 27 (see FIG. 11), as well as air-struts 29 or repositioned springs 8*a* and 8*b* could provide assistance during the initial spa cover 2 lift. For instance, in FIG. 18A, an additional spring 8*c* can be added on each side between a lower hole on the fold-side lever arm 5 through a triangular spring swivel 35, attached to the bolt 20 anchoring the upper spring 8*a*. This decreases the apparent weight of the folded cover stack 2 when uncovering the spa 17, and this extra spring 8*c* makes the folded cover stack 2 tend to lift more evenly. FIG. 18(B) shows this same lift assist function powered by torsion springs 34 installed at the pivot points of the fold-side lever arms 5 to make the cover stack 2 seem lighter when initially lifting off the spa 17, and when closing. Although adjusting the angle and/or power of springs 8*a* and 8*b* could accomplish the same thing, it might be preferable to leave the proper balance of the standard model, and simply add the torsion spring 34 or lift-assist spring 8*c* for users who want or need a lighter-feeling cover 2.

FIGS. 19, 20, 22 and 23 show a spa 17 with a more compact-design spa cover lifting mechanism accomplished by putting a bend in the fold-side lever arm 36 that allows a shorter air strut 29 to go past center and start compressing again as the cover stack 2 closes on the top of the spa 17. This cushions the closing in a convenient way. It also provides initial lift assist during opening as the cover stack 2 is lifted off the top of the spa 17, and results in the cover stack lifting more evenly. The bend in the fold-side lever arm 36 is angled so as to delay air strut compression power onset until the folded cover stack 2, when opening, is past the balance point and lowering over the side to the stowed position, where the air strut 29 reaches maximum compression and balances the full weight of the cover stack 2. The bend in the fold-side lever arm 36 eliminates the need for a swivel bracket 31 as in FIGS. 13 and 14. When combined with nut plates 28 molded into the final fold cover section 2*c*, or bolt plates 43 glued to the side of the final fold cover section 2*c*, this design is highly compact and light.

In a specific implementation of the system of FIGS. 19, 20, 22 and 23, the use of a shorter Strongarm 14115 air-strut 29 with length 13.7" to 8.52" and 102 psi pressure, going over-center when closing allows for a more compact lift mechanism. The inner cover plate 7 is ⅛" aluminum, 20.25"×7.625". The storage-side pivot is at 1" in and 3.875" down. The fold-side pivot is at 9.625" in and 1.75" down (8.875" pivot-pivot). The air-strut anchor is at 1.25" in and 3.25" down. The bent fold-side lever arm 36 is 2"×½" injection-molded plastic, 17" on the long section (15.0625" hole-hole) and 5.25" on the short side (4.25" hole-ball), with a 67 degree bend (74 degrees hole-ball). The storage-side lever arm 6 is 15.875"×2"×½" injection molded plastic (13.9375" hole-hole). The bent fold-side lever arm 36 pivots on a wide base clevis ⅜" fold-side swivel post 38 affixed to the inner mounting plate 7 retained with a retaining ring 42. A storage-side pivot doubler 39 is bent ⅛" aluminum 5"×2.75", affixed to the inner mounting plate 7. The storage-side lever arm 6 pivots on a ⅜" storage-side clevis pin 41 through the inner mounting plate 7 and the storage-side pivot doubler 39, retained by a retaining ring 42. The air side of the air-strut is attached with a 1" aluminum spacer 44 to the inner cover plate 7. This implementation of a cover lifter mechanism stowing a double-fold cover 2 out of sight below the top edge of the spa 17 would be appropriate for the majority of spa installations, and sought after by spa owners who want their spa covers 2 to disappear when open.

Figure 20:
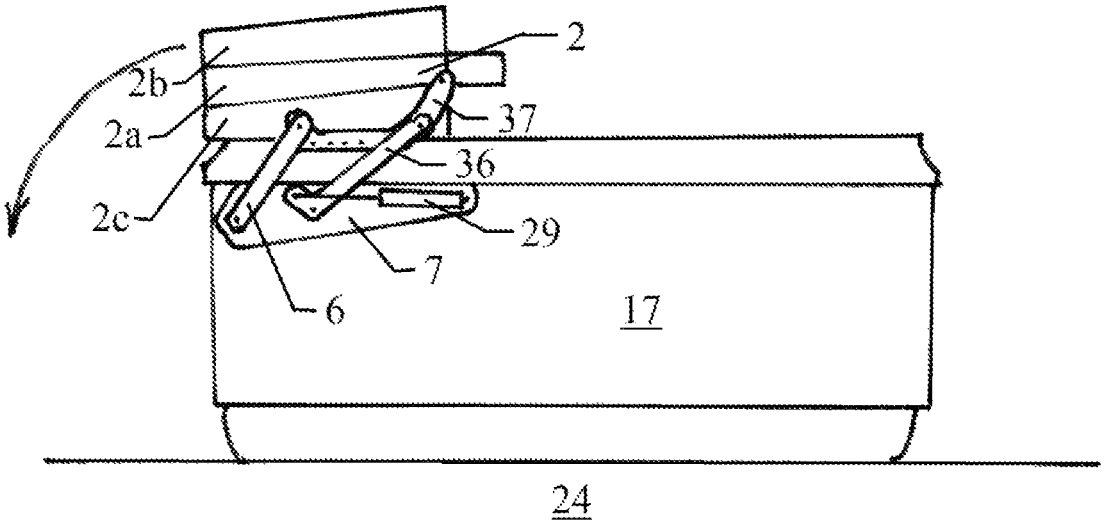
FIG. 20 shows a side view of an implementation of the spa cover lifting mechanism using an example of adaptor plates that could be used to allow a spa cover lifter designed to attach to the spa cover with imbedded nut plates, to fit a normal cover without imbedded nut plates according to present principles.

FIG. 20 shows an example of adaptor plates 37 that may be used to allow a spa cover lifter designed to attach to the spa cover 2 with imbedded nut plates 28 or bolt plates 43 glued to the side of the cover 2, to fit a normal cover 2 without imbedded nut plates, shown with the outer mounting plate removed. The adaptor plate 37 may attach to and pivot on the two swing arms 5 and 36. The same may connect to a cross bar 1 along the cover fold line, and in the mid-section attach to bolts grabbing the cover skirt 2*d*, or to a bolt plate 43 glued to the side of the cover, or directly glued to the side of the spa cover. In more detail, spa cover lifters designed for covers 2 with imbedded nut plates 28 or bolt plates 43 glued to the side of the cover 2 can be adapted to a spa cover 2 without nut plates 28 with an adaptor plate 37.

Figure 21:
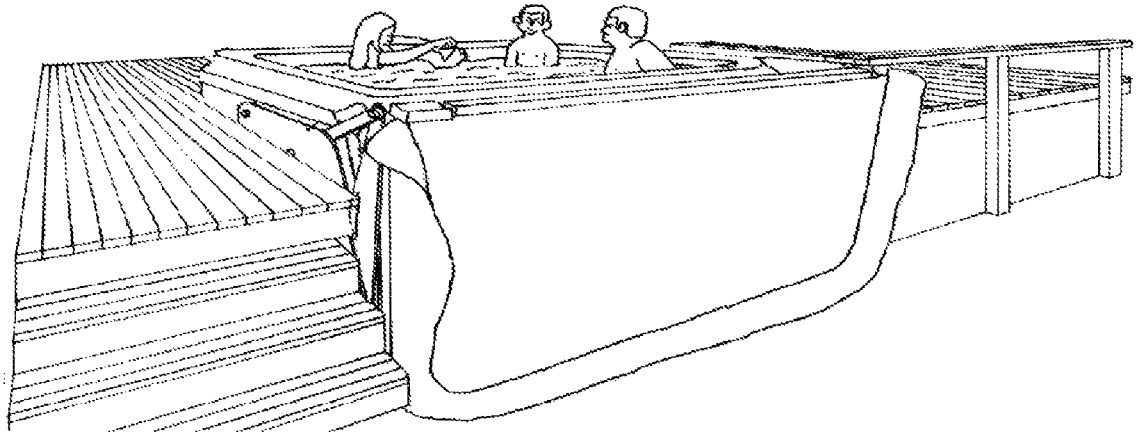
FIG. 21 shows a perspective view of an exemplary spa cover lift mechanism in use.

FIG. 21 illustrates an exemplary spa with a spa cover lifting mechanism, in use. Their fantastic view, now unobstructed, is behind the viewer.

Figure 22:
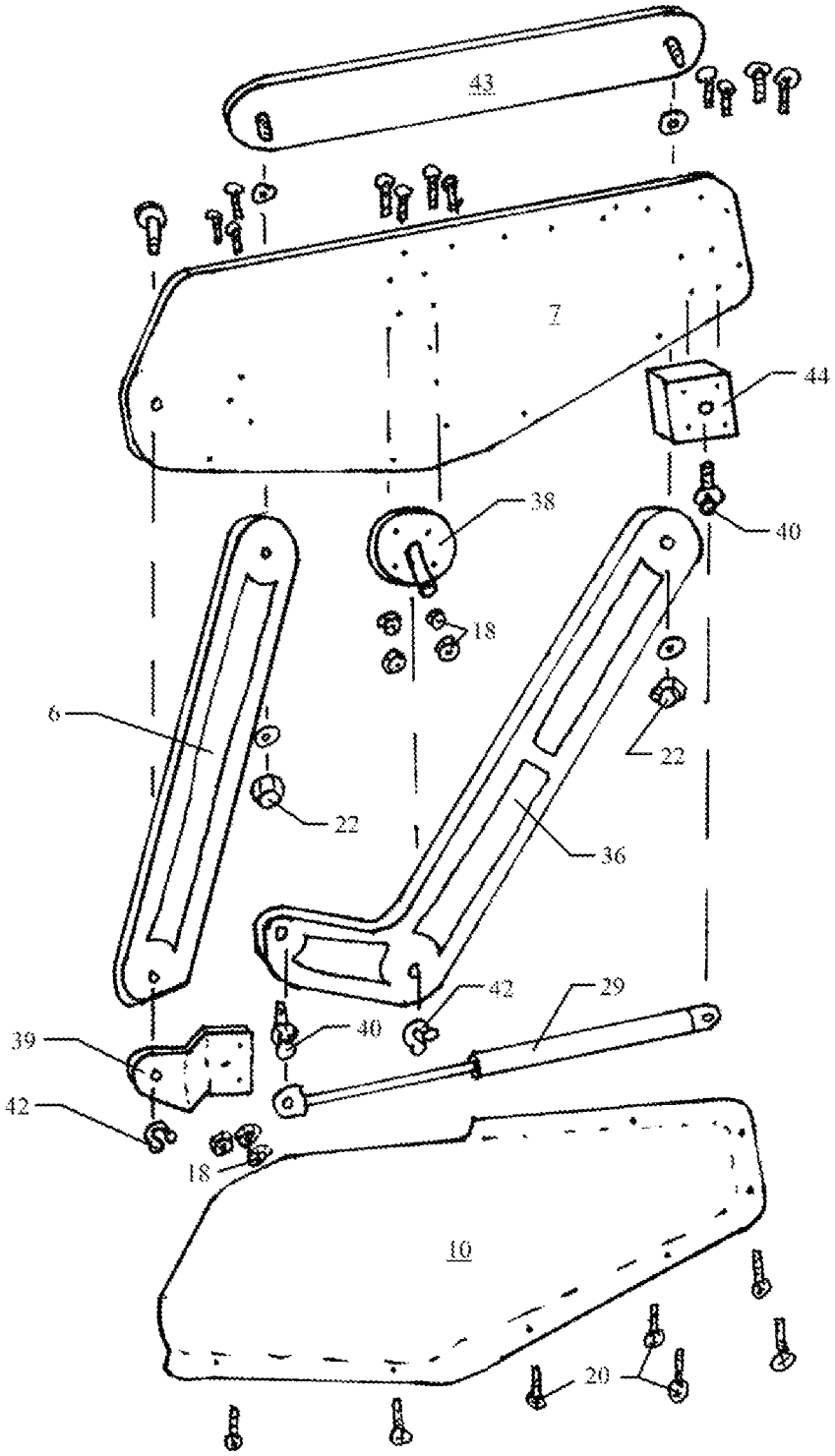
FIG. 22 is an exploded view of an implementation of a more compact spa cover lifting mechanism according to present principles.

FIG. 22 is an exploded view of the more compact double-fold cover vertical adjacent stowage spa cover lifting mechanism. The wide-base fold-side swivel post 38 and storage-side pivot doubler 39 attach with recessed flathead stainless steel bolts and nuts, or rivets. to the inner mounting plate 7. The 1" aluminum air-strut anchor ball spacer 44 attaches to the inner mounting plate 7 with recessed flathead stainless bolts screwing into the threaded aluminum spacer 44 block. The air-strut anchor balls 40 screw into threaded holes in the bent fold-side lever arm 36 and the air-strut anchor ball spacer 44.

Figure 23:
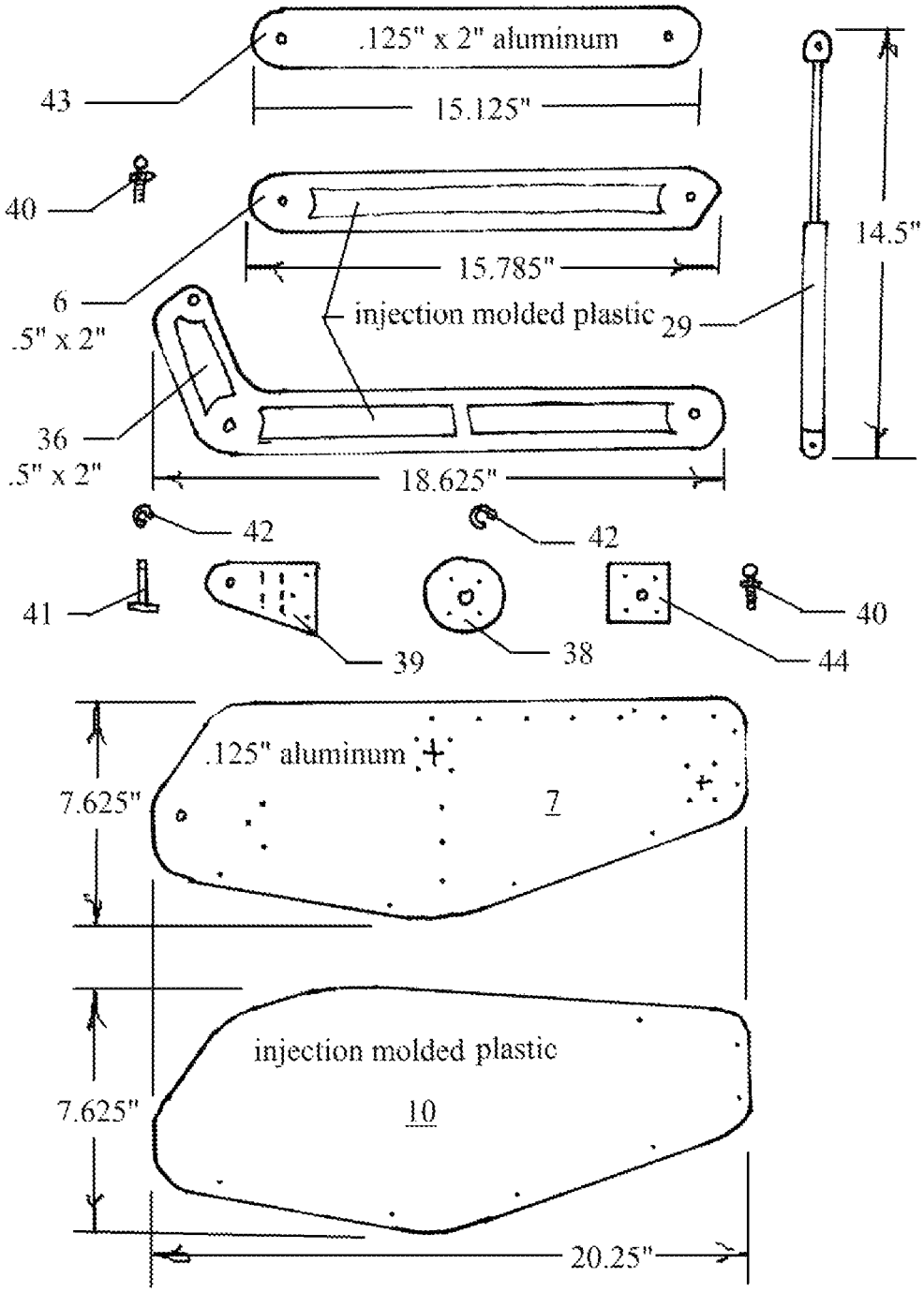
FIG. 23 is a parts diagram of a more compact spa cover lifting mechanism according to present principles.

FIG. 23 is a parts diagram of the more compact spa cover lifter components, in this implementation from a Jacuzzi® model J-365 with vertical adjacent stowage configuration. It will be understood that other spa models may have similar components, appropriately-sized.

Variations

Systems and methods according to present principles allow adjustment to fit other spas. While an initial design was sized to fit a Jacuzzi model 365, variations are possible. The length of the lever arms 4 and 5, cross bar 1 and side plates 3, cover imbedded nut plate 36 positions, and spring 8*a*, 8*b*, 8*c*, 27 and 34 and air-strut 29 size, tension and/or cushioning can be adjusted to achieve the same functionality with any size spa, as can be seen in the various examples herein.

Telescoping Tubes to Fit Multiple-Size Spa Covers—The initial design uses flat bar lever arms 4 and 5, but these components and the cross bar 1 could be made from telescoping tubes that would allow highly flexible sizing so that one kit would fit more spa sizes.

Decorative Wood Cross Bar—Some users may like the look and rust-free advantage of a wood cross bar 1. This would be very attractive in contrast with the black and silver mechanism. It would be a simple modification, replacing the ⅜"×2" hex bolts 16 with stainless ⅜"×2" hex screws into the wood cross bar 1.

Under Strap Cover Grab—The current rubber bumpers 13 are attached through the cover skirt 2*d* with five bolts 12, to lift the stowage-side of the cover stack 2 clear of the spa top edge 17*a*. Another way to lift the stowage-side of the cover stack 2 would be to use a single bolt through the side plate 3 and cover skirt 2*d* that has a strap anchor on the inside, fixing a nylon strap that extends under the stowage-side cover stack 2 to a mirror-image strap anchor through the opposite side plate 3. This would make changing the spa cover 2 easier.

Motorized Mechanism—With the ease of motion of this cover lift mechanism, it would be desirable to incorporate a small electric motor on each side, with spur gear, sprocket, limit switches and an open-close key switch—to uncover or cover the spa 17 with the turn of a key or press of a button.

Materials—This mechanism can be effectively constructed from many different materials, such as aluminum, steel, stainless steel, injection-molded plastic or brass.

Non-Rusting Materials or Treatments—All components of the current mechanism are constructed of non-rusting aluminum or stainless steel, except generally for the steel cross bar 1 and the steel springs 8*a*, 8*b* and 8*c*, torsion bar 27, and/or torsion springs 34. A stainless steel tube could be used for the cross bar 1, or the steel tube could be wrapped in shrink wrap or powder coated. The springs 8*a*, 8*b*, 8*c*, 27 and 34 could be stainless steel or powder coated.

Hidden Cross Bar 1—The spa cover 2 could be designed with a full-width reinforced tubular passage along the hinge line of the cover 2. The current ¾" steel bar 1 would fit into this tubular passage. This would hide the cross bar 1 when the cover 2 is in the closed position, making for a cleaner look and reducing exposure of the cross bar 1 to the elements.

In other variations, the systems and methods according to present principles may be applied to make certain prior art systems better, e.g., to afford a "disappearing cover" functionality.

For example, U.S. Pat. No. 5,996,137, entitled "SPA COVER LIFT FRAME" discloses a single-fold cover that is guided open by a lift frame on each side of the spa, connected by a cross bar at the fold line of the spa cover. Later, U.S. Pat. No. 8,813,275, entitled "SPA COVER" discloses a rigid single-fold cover of this same design. The open cover stack is stowed vertically on one side of the spa, but with almost the entire cover stack in full view, above the top edge of the spa. Such a lifter could be modified (see FIG. 17) to stow the cover stack out of sight below the top edge of the spa by using a double-fold cover, and changing the side pivots and arms to stow the folded cover stack lower. If stowage space were provided on the stowage side, beside and below the pad on which the spa is resting, then the pivots and arms could be adjusted to fold, lift and stow a single-fold cover out of sight below the top edge of the spa, or the single-fold cover stack could be stowed inclined beside the spa resting on the pad. It would need to incorporate springs or air-struts to cushion the stowage and assist the user in lifting the folded cover stack up and out of stowage to close. Since this design has only a single pivot arm on each side, supporting the cover stack only at the fold line, and with no support of the stowage-side of the cover, there would also be a problem with the folded cover stack dragging on the stowage-side upper lip of the spa during opening and closing, with potential wear to the cover bottom and to the spa lip edge. Additional swing arms that support the stowage-side of the folded cover stack would have to be added to overcome this problem. FIGS. 10 and 11 illustrate how a double-fold version of the rigid cover could be conveniently folded in a "Z" motion with the assistance of torsion bars, then the folded cover stack could be assisted off the spa with air struts and/or torsion springs. FIGS. 12, 13 and 14 illustrate a double-fold version of the rigid cover using a rolling motion. Two lever arms on each side 5 and 6 would guide the folded cover stack 2 up and over the upper storage-side edge of the spa 17*a*, and down into a storage position out of sight vertically adjacent to the spa. When closing the cover, the two lever arms on each side 5 and 6 would support and guide the cover stack 2 up and clear of the upper storage-side edge of the spa, assisted by air struts 29 and/or torsion springs 34, to touch down lightly, buffered by the over-center air-strut 29, in the perfect position onto the top of the spa 17.

Another, U.S. Pat. No. 5,819,332, entitled "SPA/HOT TUB COVER REMOVAL APPARATUS AND METHOD" discloses a single-fold cover that is folded and guided by a swing arm on each side of the spa, and two additional swing arms, assisted by air-struts, attached to the stowage-side of the cover and spa side. This mechanism guides the folded cover up and off of the spa, to a stowage position beside the spa, but protruding at least a foot above the top edge of the spa, thereby blocking the view to that side. Such a lifter could be modified (see FIGS. 15 and 16) to stow the cover stack out of sight below the top edge of the spa by using a single-fold or double-fold cover, and changing the side and end pivots and arms to stow the folded cover stack lower. If stowage space were provided on the stowage side, beside and below the pad on which the spa is resting, then the pivots and arms could be adjusted to fold, lift and stow a single-fold cover out of sight below the top edge of the spa (see FIG. 15), or the single-fold cover stack could be stowed inclined beside the spa resting on the pad. The pivots and arms could be adjusted to fold, lift and stow a double-fold cover out of sight below the top edge of the spa (see FIG. 16). The air-struts would need to be adjusted to cushion the stowage and assist the user in lifting the folded cover stack up and out of lower stowage to close.

This disclosure, its aspects and implementations, are not limited to the specific components or assembly procedures disclosed herein. Many additional components and assembly procedures known in the art consistent with the intended spa and spa cover assembly and/or assembly procedures for a spa, spa cover, and spa cover lifter will become apparent for use with implementations of spas, spa covers, and spa cover lifter assemblies from this disclosure. Accordingly, for example, although particular spas, spa covers, and spa cover lifting assembly may be disclosed, such spa, spa cover, and spa cover lifter assemblies may comprise any shape, size, style, type, model, version, measurement, concentration, material, quantity, and/or the like as is known in the art for such spas, spa covers, and spa cover lifter assemblies and implementing components, consistent with the intended operation of the spa, spa cover, and spa cover lifting assembly.

Reference is made throughout this document to spas, spa covers, and spa cover lifting mechanisms. It is understood, however, that the spas referenced herein include hot tubs, Jacuzzis and other such water containing units.

The accompanying claims are intended to cover such modifications as would fall within the true spirit and scope of the disclosures set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

TABLE I

| Spa Cover Lifter Parts (Exemplary) |
|---|
| cross bar 1 |
| spa cover 2 |
| first-fold cover section 2a |
| middle-fold cover section 2b |
| final-fold cover section 2c |
| cover skirt 2d |
| side plates 3 |
| cover lift pads 4 |
| fold-side lever arms 5 |
| stowage-side lever arms 6 |
| inner mounting plates 7 |
| springs 8 |
| fold-side spring 8a |
| storage-side spring 8b |
| lift assist spring 8c |
| swivels 9 |
| outer mounting plates 10 |
| couplers 11 |
| #20 × 1.75" stainless bolts 12 |
| rubber strips 13 |
| #20 nylon lock nuts 14 |
| ⅜" × 1¼" stainless carriage bolts 15 |
| ⅜" × 2" stainless hex bolts 16 |
| spa 17 |
| stowage-side upper lip 17a |
| #10 stainless steel nuts 18 |
| ⅜" × 2" stainless steel carriage bolts 20 |
| #10 × 2" stainless steel bolts 21 |
| ⅜" stainless nylon lock nuts 22 |
| ⅜" stainless nuts 23 |
| spa pad 24 |
| deck 25 |
| fastener 26 |
| torsion bars 27 |
| nut plates 28 |
| air-struts 29 |
| bent stowage-side lever arm 30 |
| swivel bracket 31 |
| single bent lever arm 32 |
| bumper stop 33 |
| torsion springs 34 |
| triangular spring swivel 35 |
| bent fold-side lever arm 36 |
| adaptor plate 37 |
| fold-side swivel post 38 |
| storage-side pivot doubler 39 |
| air-strut anchor ball 40 |
| storage-side clevis pin 41 |
| retaining ring 42 |
| bolt plate 43 |
| anchor ball spacer 44 |
| spa cover lifting mechanism 100 |

TABLE II

| Spa | Width (in.) W | ½ Width (in.) W/2 | Height (in.) H | W/2 < H | W/3 < H |
|---|---|---|---|---|---|
| Hot Springs Spas | | | | | |
| Grandee, Envoy | 91 | 45.5 | 38 | No | Yes |
| Jetsetter | 66 | 33 | 33 | Yes | Yes |
| Vanguard | 87 | 43.5 | 36 | No | Yes |
| Sovereign | 80 | 40 | 33 | No | Yes |
| Prodigy | 78 | 39 | 33 | No | Yes |
| Aria | 87 | 43.5 | 36 | No | Yes |
| Caldera Spas | | | | | |
| Utopia | 91 | 45.5 | 38 | No | Yes |
| Geneva, Niagara | 90 | 45 | 38 | No | Yes |
| Tahitian | 84 | 42 | 36 | No | Yes |

TABLE II-continued

| Spa | Width (in.) W | ½ Width (in.) W/2 | Height (in.) H | W/2 < H | W/3 < H |
|---|---|---|---|---|---|
| Jacuzzi Spas | | | | | |
| J-495 | 90 | 45 | 41 | No | Yes |
| J-470 | 91 | 45.5 | 39 | No | Yes |
| J-375, J-385 | 91 | 45.5 | 38 | No | Yes |
| J-355, J-365, J-LX | 84 | 42 | 38 | No | Yes |
| J-270, J-280 | 90 | 45 | 37 | No | Yes |
| J-235, J-245, J-335, J-345, J-LXL | 84 | 42 | 38 | No | Yes |
| J-480 | 94 | 47 | 39 | No | Yes |
| J-275 | 90 | 45 | 36 | No | Yes |
| J-465 | 88 | 44 | 39 | No | Yes |
| J-425 | 76 | 38 | 39 | Yes | Yes |
| J-325 | 76 | 38 | 34 | No | Yes |
| J-315, J-415 | 66 | 33 | 32 | No | Yes |
| J-210 | 76 round | 39 | 36 | No | Yes |
| Champaign Spas | | | | | |
| Constance, Victoria | 88 | 44 | 36 | No | Yes |
| Maxxus, Aspen | 90 | 45 | 41.5 | No | Yes |
| Optima, Cameo, McKinley, Ramona | 89 | 44.5 | 37.5 | No | Yes |
| Majesta, Altamar | 81 | 40.5 | 37.5 | No | Yes |
| Marin, Montclair | 75 | 37.5 | 33 | No | Yes |
| Capri, Dover | 69 | 34.5 | 30.5 | No | Yes |
| Chelsle, Hamilton | 89 | 44.5 | 36 | No | Yes |
| Certa | 81 | 40.5 | 36 | No | Yes |
| Peyton, Edison | 84 | 42 | 36 | No | Yes |
| Denali | 79 round | 38.5 | 36 | No | Yes |
| Tacoma | 68 | 34 | 31 | No | Yes |
| Caldera Spas | | | | | |
| Cantabria | 96 | 48 | 38 | No | Yes |
| Geneva, Niagara, Palatino | 89 | 44.5 | 38 | No | Yes |
| Tahitian, Marino, Vanto | 84 | 42 | 36 | No | Yes |
| Makena, Salina | 89 | 44.5 | 36 | No | Yes |
| Martinique | 76 | 38 | 34 | No | Yes |
| Kauai | 65 | 32.5 | 29 | No | Yes |
| Tarino | 82 | 41 | 33 | No | Yes |
| Aventine | 64 | 32 | 29 | No | Yes |

The invention claimed is:

1. A spa cover lifting device operable to be attached between a spa and a spa cover, comprising:

at least four lever arms, two on each side of a spa, each attached to a bolt plate that is configured to attach to a side of a spa cover, and at least one air-strut on each side of the spa and coupled to one of the lever arms on the respective side, the at least one air-strut configured to push on one or more of the lever arms on each side to assist in lifting the spa cover up, over and down into a stowed configuration when transitioning from a deployed configuration to the stowed configuration, and wherein the lifting device is configured such that, when moving from the stowed configuration to the deployed configuration, the movement is assisted by the air-strut to lift and guide the spa cover into the deployed configuration, wherein the stowed configuration is such that the spa cover is not covering the spa and wherein the deployed configuration is such that the spa cover is covering the spa, and wherein the spa cover lifting device is configured to move the spa cover between the stowed configuration and the deployed configuration, and vice-versa, such that in the stowed configuration the spa cover is disposed on only one side of the spa and below a top plane of the spa.

2. The spa cover lifting device of claim 1, wherein the spa cover has a double-fold to form a cover stack, wherein two of the at least four lever arms are bent lever arms and are on each fold-side configured to allow an air-strut, when the cover stack is closing onto the top of the spa, to travel over-center, past the bent lever arm pivot point, such that the air-strut is re-compressing as the cover stack approaches the top of the spa, to cushion the closing and further to provide a lift assist on initial opening, and wherein each lever arm is attached to one or more imbedded nut plates or bolt plates in the lowest section of the cover stack.

3. The spa cover lifting device of claim 2, further comprising a crossbar, such that the lifting device is configured to be used with spa covers not outfitted with imbedded nut plates.

4. The spa cover lifting device of claim 2, wherein each lever arm is telescoping to allow flexible sizing.

5. The spa cover lifting device of claim 1, wherein the spa cover lifting device is constructed from aluminum, steel, stainless steel, injection-molded plastic, or brass.

6. The spa cover lifting device of claim 1, wherein each lever arm is telescoping to allow flexible sizing.

* * * * *